US012352266B2

(12) United States Patent
Weih

(10) Patent No.: US 12,352,266 B2
(45) Date of Patent: Jul. 8, 2025

(54) ROTOR PAIR FOR A COMPRESSION BLOCK OF A SCREW MACHINE

(71) Applicant: Kaeser Kompressoren SE, Colburg (DE)

(72) Inventor: Gerald Weih, Rodental (DE)

(73) Assignee: KAESER KOMPRESSOREN SE, Colburg (DE)

( * ) Notice: Subject to any disclaimer, the term of this patent is extended or adjusted under 35 U.S.C. 154(b) by 0 days.

(21) Appl. No.: 18/501,260

(22) Filed: Nov. 3, 2023

(65) Prior Publication Data

US 2024/0175436 A1 May 30, 2024

Related U.S. Application Data

(60) Continuation of application No. 17/577,212, filed on Jan. 17, 2022, now abandoned, which is a division of (Continued)

(30) Foreign Application Priority Data

Apr. 25, 2014 (DE) ..... 10 2014 105 882.8

(51) Int. Cl.
*F04C 18/08* (2006.01)
*F04C 18/16* (2006.01)
*F04C 18/20* (2006.01)

(52) U.S. Cl.
CPC ..... *F04C 18/084* (2013.01); *F04C 18/16* (2013.01); *F04C 18/20* (2013.01); (Continued)

(58) Field of Classification Search
CPC ..... F04C 18/084; F04C 18/16; F04C 18/18; F04C 18/20; F04C 2240/20; (Continued)

(56) References Cited

U.S. PATENT DOCUMENTS 2,622,787 A 12/1952 Robert
3,138,110 A 6/1964 Whitfield
(Continued)

FOREIGN PATENT DOCUMENTS

CN 102052322 A 5/2011
CN 102352840 A 2/2012
(Continued)

OTHER PUBLICATIONS

Extended European Search Report corresponding to EP 23198449.3; dated Mar. 6, 2024, (11 pages).
(Continued)

*Primary Examiner* — Theresa Trieu
(74) *Attorney, Agent, or Firm* — Myers Bigel, P.A.

(57) ABSTRACT

The invention relates to a rotor pair for a compressor block of a screw machine, wherein the rotor pair comprises a secondary rotor that rotates about a first axis and a main rotor that rotates about a second axis, wherein the number of teeth of the main rotor is 3 and the number of teeth of the secondary rotor is 4. The relative profile depth of the secondary rotor is at least 0.5, preferably at least 0.515, and at most 0.65, preferably at most 0.595. rk1 is an addendum circle radius drawn around the outer circumference of the secondary rotor and rf1 is a dedendum circle radius starting at the profile base of the secondary rotor, wherein the ratio of the axis distance of the first axis from the second axis and the addendum circle radius rk1 is at least 1.636, and at most 1.8, preferably at most 1.733.

18 Claims, 17 Drawing Sheets

Related U.S. Application Data application No. 16/530,002, filed on Aug. 2, 2019, now Pat. No. 11,248,606, which is a division of application No. 15/306,592, filed as application No. PCT/EP2015/059070 on Apr. 27, 2015, now Pat. No. 10,400,769.

(52) U.S. Cl.
CPC ..... *F04C 2240/20* (2013.01); *F04C 2240/30* (2013.01); *F04C 2240/60* (2013.01)

(58) Field of Classification Search
CPC .. F04C 2240/30; F04C 2240/60; F01C 1/084; F01C 1/16; F01C 1/18; F01C 1/20
See application file for complete search history.

(56) References Cited

U.S. PATENT DOCUMENTS

| | | | | |
|---|---|---|---|---|
| 3,275,226 | A | 9/1966 | Whitfield | |
| 3,282,495 | A | 11/1966 | Walls | |
| 3,437,263 | A | 4/1969 | Persson | |
| 4,350,480 | A | 9/1982 | Bammert | |
| 4,412,796 | A | 11/1983 | Bowman | |
| 4,527,967 | A | 7/1985 | Ingalls | |
| 4,643,654 | A | 2/1987 | Rinder | |
| 5,624,250 | A | 4/1997 | Son | |
| 7,163,387 | B2 | 1/2007 | Tang | |
| 8,702,409 | B2 | 4/2014 | Cavatorta et al. | |
| 10,400,769 | B2 * | 9/2019 | Weih | F04C 18/084 |
| 11,248,606 | B2 * | 2/2022 | Weih | F04C 18/084 |
| 2003/0170135 | A1 | 9/2003 | Kim et al. | |

FOREIGN PATENT DOCUMENTS

| | | | |
|---|---|---|---|
| CN | 103195716 | A | 7/2013 |
| DE | 1428265 | A1 | 1/1969 |
| DE | 2911415 | C2 | 4/1982 |
| DE | 3246685 | A1 | 6/1983 |
| DE | 3230720 | C2 | 5/1994 |
| DE | 19539002 | A1 | 4/1997 |
| EP | 0122725 | A1 | 10/1984 |
| EP | 0166531 | A1 | 1/1986 |
| EP | 0398675 | A2 | 11/1990 |
| FR | 953057 | A | 11/1949 |
| GB | 627162 | A | 7/1949 |
| GB | 2112460 | B | 6/1985 |
| GB | 2501302 | B | 8/2016 |
| JP | S60216089 | A | 10/1985 |
| JP | 2007146659 | A | 6/2007 |
| JP | 2009243325 | A | 10/2009 |
| KR | 100313638 | B1 | 12/2001 |
| WO | 9721926 | A1 | 6/1997 |

OTHER PUBLICATIONS

Wu, et al., "Improved rotor profiling based on the arbitrary sealing line for twin-screw compressors", Mechanism and Machine Theory, 43(6), 2008, 695-711.
Wu, et al., "Rotor Profile Design for the Twin-Screw Compressor Based on the Normal-Rack Generation Method", Journal of Mechanical Design, 130(4), 2008, 042601-1-042601-8.
Third Party Observation corresponding to EP 15736405.0; Dated: May 24, 2017, (10 pages).
Third Party Observation Statement of Facts and Grounds filed in corresponding EP 15736405.0 on Dec. 28, 2018, (11 pages, including English translation).
Third Party Observation corresponding to EP 18163593.9; Dated: Oct. 26, 2018, (12 pages).
Third Party Observation filed in corresponding EP 15736405.0 on May 16, 2017, (13 pages, including English translation).
EP Office Action corresponding to EP 19190907.6; Mailed: Feb. 22, 2021, (14 pages).
Translations of technical documents cited with Third Party Observations in the European Patent Office for purposes of examination, publication date conceded to be at least one year prior to the application's priority date, (15 pages).
Third Party Observation Statement of Facts and Grounds filed in corresponding EP 15736405.0 on Jan. 3, 2019, (181 pages, included English translation).
Third Party Observation corresponding to DE 102014105882; Dated: Dec. 12, 2016, (2 pages).
Declaration of Dr. Andreas Foerster under 1.132; Dated: Jan. 8, 2019, (37 pages).
Third Party Observation filed in corresponding EP 15736405.0 on Dec. 13, 2016, (4 pages, including English translation).
Third Party Submission of Ingersoll-Rand Company regarding corresponding EP Application No. 15736405.0; Dated: Aug. 13, 2020, (70 pages).
Chinese Office Action for corresponding to CN 2015800226937; Mailed: Mar. 2, 2018 (with translated Search Report), (8 pages).
Third Party Observation corresponding to EP 15736405.0; Dated: Jul. 14, 2017, (8 pages).
Grafinger, Manfred, "Die computerunterstützte Entwicklung der Flankenprofile für Sonderverzahnungen von Schraubenkompressoren (The computer-aided development of flank profiles for special gears of screw compressors)", Dissertation, Vienna University of Technology. Aachen: Shaker Verlag GmbH., 2010, (115 pages).
Helpertz, Markus, "Methode zur stochastischen Optimierung von Schraubenrotorprofilen (Method for the Stochastic Optimization of Screw Rotor Profiles)", Dissertation. Dortmund: Technical University of Dortmund (201 pages), 2003, 9-12, 144, 149, 162 und 163.
Huster, et al., "Berechnung der Gaskrafte in Schraubenverdichtern (Computation of the Gas Forces in Screw Compressors)", VDI Reports No. 1932 (including English translation), 2006, 115-130.
Rinder, Laurenz, "Schraubenverdichter (Screw Compressors)", Springer, Wien, 1979, 111-114.
Rinder, Laurenz, "Translation of: Schraubenverdichter (Screw Compressors)", Springer, Wien, 1979, 111-114.
Fister, Werner, "12—Schraubenverdichter (Translated: Screw Compressor)", In Fluidenergiemaschinen (Translated: Fluid Energy Machines), vol. 2, Springer, Berlin, Heidelberg, 1986, (120 pages, including partial English translation).
Singh, et al., "Effect of design parameters on oil-flooded screw compressor performance", International Compressor Engineering Conference; Purdue University, School of Mechanical Engineering, 1986, 71-88.
Opposition of European Patent No. EP3358189, Jul. 17, 2024, (60 pages).
Opposition of European Patent No. EP3597920, Jun. 11, 2024, (41 pages).
Opposition of Indian Patent No. 497089, Sep. 5, 2024, (79 pages).
Kovacevic, A., et al., "Fluid-Solid Interaction in Design of Multifunctional Screw Machines", International Design Conference—Design 2004, May 18-21, 2004. Dubrovnik, Croatia, 2004, (6 pages).
Mujic, E., et al., "Noise generation and suppression in twin-screw compressors", Proceedings of the Institution of Mechanical Engineers, Part E: Journal of Process Mechanical Engineering, 225(2), 2011, 127-148.
Mujic, E., et al., "Numerical modelling of gas pulsations in a screw compressor", City University London, Centre for Positive Displacement Compressor Technology; London, UK, 2009, (10 pages).
Mujic, E., et al., "The influence of port shape on gas pulsations in a screw compressor discharge chamber", Proceedings of the Institution of Mechanical Engineers, Part E: Journal of Process Mechanical Engineering, 222(4), 2008, 211-223.
Rinder, Laurenz, "Chapter 3—The Asymmetric SRM Profile (translation)", In Screw Compressors (Schraubenverdichter). Springer-Verlag/Wien. (English translation included), 1979, 27-132.
Scorpath, "Standard 4/5 Rotor Profile", obtained directly from SCORPATH software either in the SCORPATH interface (see A. in DI 1) or as a DXF file (see B. in DI 1). SCORPATH software available in 2004., 2004.

(56) References Cited

OTHER PUBLICATIONS

Stosic, Nikola, et al., "A Twin Screw Combined Compressor and Expander for CO2 Refrigeration Systems", International Compressor Engineering Conference at Purdue University; Paper No. 1591, 2002, (9 pages).
Stosic, N., "Screw Compressor Modelling, Design and Use", Presentation in "Screw Compressor Basics", City University London, Apr. 29, 2003, (73 pages).
You, Cheng Xiang, "A theoretical study of rotor forces and torques in helical twin screw compressors", Doctoral Thesis. University of Strathclyde, Glasgow, UK; Division of Dynamics and Control Department of Mechanical Engineering, 1994, (208 pages).
You, C. X., et al., "Optimum rotor geometrical parameters in refrigeration helical twin screw compressors", International Compressor Engineering Conference at Purdue University; Paper No. 1074, 1996, (7 pages).
Petition for Invalidation corresponding to CN 201580022693.7 (English machine translation included), Jul. 19, 2024, 106 pp.
Xing, Ziwen , "Screw Compressors: Theory, Design and Application", China Machine Press, Beijing, China (English machine translation included), 2000, 43 pp.
Zhang, Weimin , "Research on rotor profile of semi-enclosed screw compressor with speed increasing gear and its chiller development", Masters thesis, Dalian University of Technology (English machine translation included), Mar. 5, 2003, 139 pp.

* cited by examiner

ROTOR PAIR FOR A COMPRESSION BLOCK OF A SCREW MACHINE

RELATED APPLICATIONS

The present application is a continuation of U.S. patent application Ser. No. 17/577,212. filed Jan. 17, 2022, which is a divisional of U.S. patent application Ser. No. 16/530,002 filed Aug. 2, 2019, now U.S. Pat. No. 11,248,606, which is divisional of U.S. patent application Ser. No. 15/306,592, filed Oct. 25, 2016, now U.S. Pat. No. 10,400,769, which is a 35 U.S.C. § 371 national phase application of PCT International Application No. PCT/EP2015/059070, filed Apr. 27, 2015, which claims priority from German Patent Application No. 10 2014 105 882.8, filed Apr. 25, 2014; the disclosures of which are hereby incorporated herein by reference in their entirety. PCT International Application No. PCT/EP2015/059070 is published in German as PCT Publication No. WO 2015/162296.

FIELD OF THE INVENTION

The invention relates to a rotor pair for a compressor block of a screw machine, where the rotor pair consists of a main rotor that rotates about a first axis and a secondary rotor that rotates about a second axis. The invention further relates to a compressor block having a corresponding rotor pair.

BACKGROUND

Screw machines, whether this be in the form of screw compressors or in the form of screw expanders, have been in practical use for several decades. Configured as screw compressors, they have superseded reciprocating piston compressors as compressors in many areas. With the principle of the intermeshing pair of screws, not only gases can be compressed by applying a certain amount of work. The application as a vacuum pump also opens up the use of screw machines to achieve a vacuum. Finally an amount of work can also be produced by passing through pressurized gases the other way round so that mechanical energy can also be obtained from pressurized gases by means of the principle of the screw machine.

Screw machines generally have two shafts arranged parallel to one another on which a main rotor on the one hand and a secondary rotor on the other hand are located. Main rotor and secondary rotor intermesh with a corresponding screw-shaped toothed structure. Between the toothed structures and a compressor housing which accommodates the main and secondary rotor, a compression chamber (working chambers) is formed by the tooth gap volumes. Starting from a suction region as the rotation of main and secondary rotor progresses, the working chamber is initially closed and then continuously reduced in volume so that a compression of the medium occurs. Finally as rotation progresses, the working chamber is opened towards a pressure window and the medium is expelled into the pressure window. Screw machines configured as screw compressors differ by this process of internal compression from Roots blowers which operate without internal compression.

Depending on the required pressure ratio (ratio of output pressure to input pressure), various tooth number ratios are appropriate for efficient compression.

Typical pressure ratios can be between 1.1 and 20 depending on the tooth number ratio, where the pressure ratio is the ratio of compression end pressure to suction pressure. The compression can take place in a single- or multistage manner. Attainable final pressures can, for example, lie in the range of 1.1 bar to 20 bar. Insofar as at this point or hereinafter in the present application reference is made to pressure information in "bar", in each case this pressure information relates to absolute pressures.

In addition to the already mentioned function as a vacuum pump or as a screw expander, screw machines can be used in various areas of technology as compressors. A particularly preferred area of application is the compression of gases such as, for example, air or inert gases (helium, nitrogen, . . . ). However, it is also possible, although this imposes especially structurally different requirements, to use a screw machine to compress refrigerants, for example for air-conditioning systems or refrigeration applications. For the compression of gases specifically with higher pressure ratios, usually a fluid-injected compression, in particular an oil-injected compression is used; however it is also possible to operate a screw machine according to the principle of dry compression. In the lower-pressure area, screw compressors are occasionally also designated as screw blowers.

Over the past few decades, considerable success has been achieved in regard to the manufacturability, reliability, smooth running and efficiency of screw machines. Improvements or optimizations in this context frequently relate to optimizations of the efficiency depending on number of teeth, wrap-around angle and length/diameter ratio of the rotors. The incorporation of the transverse sections in the optimization process has only taken place recently.

Experiments have shown that the transverse section of the rotors, in particular the transverse section of the secondary rotor has a substantial influence on the energy efficiency. In order to obey the toothed structure laws, the transverse section of the secondary rotor must find its correspondence in the transverse section of the main rotor. The profile of the rotor in a plane perpendicular to the axis of the rotor is here designated as transverse section. Various types of transverse section generation such as, for example, rotor- or rack-based transverse section generating methods are now known from the prior art. If a specific process has been decided upon, a first draft transverse section is generated in a first step. This is conventionally further optimized in a plurality of successive (revising) steps according to various criteria.

Here both the optimization aims per se (energy efficiency, smooth running, low costs) and also the fact that the improvements of one parameter in some cases necessarily result in a deterioration of another parameter, are known. However, there is a lack of a specific solution as to how a good overall optimization result (i.e. a compromise between the various individual parameter optimizations) can be achieved.

Some optimization approaches which are known in the prior art with a view to improving the energy efficiency, smooth running and costs will be explained as an example hereinafter. Furthermore, problems which can arise here will also be mentioned.

1 Energy Efficiency

The energy efficiency of compressor blocks can advantageously be influenced in a known manner by minimizing the internal leakages in the compressor block and in particular by reducing the gap between main rotor and secondary rotor. Specifically here a distinction should be made between the profile gap and the blow hole:

Via the profile gap the pressure-side working chambers have direct communication to the suction side and therefore the greatest possible pressure difference for backflows.

Consecutive working chambers are interconnected via a theoretically unnecessary passage which is designated as blow hole. In some cases this is also designated as head rounding opening. This blow hole is obtained through the head rounding of the profiles, in particular the profile of the secondary rotor.

Pressure-side working chambers are connected to the respectively adjacent working chamber via pressure-side blow holes, suction-side working chambers are connected to the respectively adjacent working chambers via suction-side blow holes. Unless specified otherwise, the term "blow hole" is to be understood hereinafter as "pressure-side blow hole".

Ideally, in order to minimize internal leakages, a short profile gap length should be combined with a small (pressure-side) blow hole. However, the two quantities behave fundamentally contrarily. That is, the smaller the blow hole is modelled, the larger the profile gap length must be. Conversely, the blow hole becomes larger, the shorter is the profile gap length. This is explained, for example, by Helpertz in his dissertation "Method for the stochastic optimization of screw rotor profiles", Dortmund, 2003, on page 162.

The requirement for a short profile gap length can be achieved in a known manner with a flat profile with a relatively small relative profile depth of the secondary rotor. Whether a profile is designed to be rather flat (small profile depth) or deep (large profile depth) can be clearly quantified here by means of the so-called "relative profile depth of the secondary rotor" which relates the difference between addendum and dedendum circle radius to the addendum circle radius of the secondary rotor. The higher is the value, the more compact is the compressor block and for example, has more quantity delivered than a comparable compressor block with the same external dimensions.

Profiles designed to be very flat accordingly have a poor utilization of installation volume, i.e. they result in large compressor blocks with comparatively high material expenditure or comparatively high manufacturing costs.

Pressure-side blow holes as described above must not be designed to be too large in order to minimize the return flow of already compressed medium in preceding working chambers (i.e., in lower-pressure working chambers). Such return flows increase the energy expenditure for the overall conveying capacity achieved and result in an undesirable increase in the temperature and pressure level during compression which overall reduces the efficiency. The area of the blow hole (blow hole area) can be kept small whereby the head roundings of the profiles in the transverse section are designed to be small. Specifically, this can be achieved by a strong curvature in the head region of the leading tooth flank of the secondary rotor and in the head region of the trailing tooth flank of the main rotor. However, the stronger is this curvature, the more rapidly production-technology limiting regions are reached since this for example results in high wear on profile millers and profile grinding disks during the manufacture of main rotor and secondary rotor.

Suction-side blow holes on the other hand do not have a negative influence on the energy efficiency since only working chambers in the suction region are interconnected via these at the same pressure.

Another cause of efficiency-reducing internal leakages is the so-called chamber interstitial volume which can form during expulsion of the last working chamber (i.e. the working chamber in which the highest pressure prevails) into the pressure window. The working chamber then no longer has a connection to the pressure window from a certain rotational angle position of the rotors. A so-called chamber interstitial volume remains between the two rotors and the pressure-side housing end wall.

This chamber interstitial volume is disadvantageous because the enclosed compressed medium can no longer be expelled into the pressure window and is even further compressed during the further rotation of the rotors, which leads to an unnecessarily high power consumption (for the over-compression), an unnecessarily high additional heat input, evolution of noise and a reduction in the lifetime, in particular of the roller bearings of the rotors. In addition, a deterioration in the specific power is caused by the fact that the fraction enclosed in the chamber interstitial volume is returned to the suction side after the over-compression and therefore is no longer available to the compressed air user. In the case of oil-injected compressors, incompressible oil is additionally in the chamber interstices and is squeezed.

2 Smooth Running

However, other properties such as, for example, the smooth running also have a decisive influence on a good profile for main rotor or secondary rotor.

In addition to good osculation of the flanks and low relative speeds between the tooth flanks of main and secondary rotor, the division of the drive torque between the two rotors also has a decisive influence on the two rotors. An unfavourable distribution is known to frequently result in so-called rotor rattling of the secondary rotor in which the secondary rotor has undefined flank contact with the main rotor and the secondary rotor consequently alternately has contact with the leading and the trailing main rotor flank. If the two rotors are held at a distance by means of a synchronous transmission, the aforesaid rotor rattling is necessarily displaced into the synchronous transmission. Good smooth running not only ensures low sound emissions from the compressor block but for example also provides for a less vibration-prone compressor block, a long lifetime of the roller bearings and low wear in the tooth structure of the rotors.

3 Costs

In particular, the manufacturability and the degree of utilization of the installation volume have an effect on the material and manufacturing costs of screw compressor blocks.

Compact compressor blocks with a high utilization of installation volume are achieved by a large tooth gap volume which in turn depends on the profile depth and the tooth thickness.

The further the relative profile depth is increased, the higher utilization of installation volume is achieved but at the same time, the risk of problems with running properties and manufacturability is higher:

With increasing profile depth, in particular the tooth profiles of the secondary rotor will necessarily become increasingly thinner and consequently increasingly flexible. This makes the rotors increasingly temperature-sensitive and when viewed overall, has an unfavourable effect on the gaps in the compressor block. The gaps have an appreciable influence on the internal leakages, i.e. return flows from higher-pressure compression chambers in the direction of the suction side, and can thus cause a deterioration in the energy efficiency of the compressor block.

Furthermore, in the case of flexible teeth the difficulties with rotor manufacture increase.

Thus for example, there is an increased risk that the requirements in particular for the shape tolerances, which are already high in any case, cannot be adhered to.

Furthermore, flexible teeth require lower feed and intersection speeds both during profile milling and also during subsequent profile grinding and thus increase the processing time and consequently the manufacturing costs.

An increasing profile depth also has the result that the rotor per se becomes more flexible. The more flexible the rotors are designed, the more the risk increases that the rotors start running amongst one another or in the compressor housing. In order to ensure operating safety even at high temperatures or at high pressures, the gaps must consequently have larger dimensions. This in turn has a negative influence on the energy efficiency of the compressor block.

SUMMARY

The above explanations are intended to show that an optimization of the individual characteristics each for itself is less expedient but for a good overall result a compromise must be found between the various (and partly contradictory) requirements.

The theoretical calculation principles for producing screw rotor profiles have already been discussed on many occasions in the literature and also describe general criteria for good transverse section profiles. For example, rotor profiles can be created and modified using the computer program developed by Grafinger (post-doctoral thesis "Computer-assisted development of flank profiles for special tooth structures of screw compressors", Vienna, 2010).

In his thesis "Method for the stochastic optimization of screw rotor profiles", Dortmund 2003, Helpertz is concerned with the automated optimization starting from a draft with regard to differently weighted characteristics.

Accordingly it is the object of the present invention to provide a rotor pair for a compressor block of a screw machine which is characterized by highly smooth running and a particular energy efficiency with high operating safety and acceptable production costs.

This object is solved with a rotor pair. Advantageous embodiments are specified in the subclaims. Further, the object is also solved with a compressor block comprising a suitably configured rotor pair.

The rotor geometry is substantially characterized by the shape of the transverse section as well as by the rotor length and the wrap-around angle, cf. "Method for the stochastic optimization of screw rotor profiles", Thesis by Markus Helpertz, Dortmund 2003, pp. 11/12.

In a transverse sectional view, secondary rotor or main rotor have a pre-determined, frequently different number of identically configured teeth per rotor. The outermost circle drawn through the axis C1 or C2 via the apex points of the teeth is designated as addendum circle in each case. A dedendum circle is defined by the points of the outer surface of the rotors nearest to the axis in transverse section. The ribs are designated as teeth of the rotor. The grooves (or recesses) are accordingly designated as tooth gaps. The surface of the tooth at and over the dedendum circle defines the tooth profile. The contour of the ribs defines the course of the tooth profile. Foot points F1 and F2 and an apex point F5 are defined for the tooth profile. The apex point F5 or H5 is defined by the radially outermost point of the tooth profile. If the tooth profile has a plurality of points with the same maximum radial distance from the central point defined by the axis C1 or C2, the tooth profile therefore follows at its radially outermost end a circular arc on the addendum circle, the apex point F5 lies precisely at the centre of this circular arc. A tooth gap is defined between two adjacent apex points F5.

The points radially nearest to the axis C1 or C2 between an observed and the respectively adjacent tooth define foot points F1 and F2. Here it also holds for the case that a plurality of points come equally close to the axis C1 or C2, i.e. the tooth profile at its lowest point follows the dedendum circle in sections, that the corresponding foot point F1 or F2 then lies on the half of this circular arc lying on the dedendum circle.

Finally, as a result of the intermeshing of main rotor and secondary rotor, a pitch circle is defined both for the secondary rotor and also for the main rotor. In screw machines and also in gear wheels or friction wheels, there are always two circles in the transverse section of the toothed structure which roll against one another during the movement. These circles on which in the present case main rotor and secondary rotor roll against one another are designated as respective pitch circles. The pitch circle diameter of main rotor and secondary rotor can be determined with the aid of axial distance and tooth number ratio.

On the pitch circles the circumferential speeds of main rotor and secondary rotor are identical.

Finally tooth gap areas between the teeth and the respective addendum circle KK are defined, namely tooth gap area A6 between the profile course of the secondary rotor NR between two adjacent apex points F5 and the addendum circle $KK_1$ or an area A7 as tooth gap area between the profile course of the main rotor (HR) between two adjacent apex points H5 and the addendum circle $KK_2$.

The tooth profile of the secondary rotor (but also of the main rotor) has a leading tooth flank in the direction of rotation and a trailing tooth flank in the direction of rotation. In the secondary rotor (NR) the leading tooth flank is hereinafter designated by $F_V$ and the trailing tooth flank by $F_N$.

The trailing tooth flank $F_N$ in its section between addendum circle and dedendum circle forms a point at which the curvature of the course of the tooth profile changes. This point is hereinafter designated as F8 and divides the trailing tooth flank $F_N$ into a convexly curved fraction between F8 and the addendum circle and a concavely curved fraction between the dedendum circle and F8. Small-part profile variations, possibly due to sealing strips or due to other local profile restructurings are not taken into account when considering the previously described change of curvature.

In addition to the pure transverse section, for the three-dimensional configuration, the following terms or parameters are definitive for a rotor, in particular the secondary rotor: firstly the wrap-around angle $\phi$ is defined. This wrap-around angle is the angle through which the transverse section is turned from the suction-side to the pressure-side rotor end face, cf. on this matter also the more detailed explanations in connection with FIG. 8.

The main rotor has a rotor length $L_{HR}$ which is defined as the distance of a suction-side main-rotor rotor end face to a pressure-side main-rotor rotor end face. The distance of the first axis C1 of the secondary rotor to the second axis C2 of the main rotor running parallel to one another is hereinafter designated as axial distance a. It is pointed out that in most cases the length of the main rotor $L_{HR}$ corresponds to the length of the secondary rotor $L_{NR}$, where in the case of the secondary rotor the length is also understood as the distance of a suction-side secondary-rotor rotor end face to a pressure-side secondary-rotor rotor end face. Finally a rotor length ratio $L_{HR}/a$ is defined, i.e. a ratio of the rotor length of the main rotor to the axial distance. The ratio $L_{HR}/a$ is in this respect a measure for the axial dimensioning of the rotor profile.

The line of engagement or the profile gap is formed by the cooperation of main rotor and secondary rotor with one another. In this case, the line of engagement is obtained as follows: the tooth flanks or main rotor and secondary rotor contact one another in a backlash-free toothed structure depending on the rotational angle position of the rotors at certain points. These points are designated as engagement points. The geometric location of all the engagement points is the line of engagement and can already be calculated in two dimensions by means of the transverse section of the rotors, cf. FIG. 7*j*.

In the transverse sectional view, the line of engagement is divided by the connecting line between the two central points C1 and C2 into two sections and specifically into a (comparatively short) suction-side and a (comparatively long) pressure-side section.

If the wrap-around angle and the rotor length (=distance between the suction-side end face and the pressure-side end face) are additionally specified, the line of engagement can also be expanded three-dimensionally and corresponds to the line of contact of main rotor and secondary rotor. The axial projection of the three-dimension line of engagement on the transverse sectional plane in turn gives the two-dimensional line of engagement illustrated by means of FIG. 7*j*. The term "line of engagement" is used in the literature both for the two-dimensional and the three-dimensional analysis. Hereinafter, unless specified otherwise, "line of engagement" is understood however as the two-dimensional line of engagement, i.e. the projection onto the transverse section.

The profile engagement gap is defined as follows: in a real compressor block of a screw machine, there is a gap between the two rotors with the installed axial spacing of main rotor and secondary rotor. The gap between main rotor and secondary rotor is designated as profile engagement gap and is the geometrical location of all the points at which the two paired rotors contact one another or have the smallest distance from one another. Through the profile engagement gap the compressing and the expelling working chambers are in communication with chambers which still have contact with the suction side. Therefore the total maximum pressure ratio is present at the profile engagement gap. Through the profile engagement gap, already compressed working fluid is transported back to the suction side and thus reduces the efficiency of the compression. Since the profile engagement gap in a backlash-free toothed structure would comprise the line of engagement, the profile engagement gap is also designated as "quasi-engagement line".

Blow holes between working chambers are formed by head roundings of the teeth of the profile. Via blow holes the working chambers are connected to the preceding and following working chambers so that (in contrast to the profile engagement gap) only the pressure difference from one working chamber to the next working chamber is present at the blow hole.

Furthermore, as is known, certain rotor pairs are usual in screw machines, for example a rotor pair in which the main rotor has three teeth and the secondary rotor has four teeth or a rotor pair in which the main rotor has four teeth and the secondary rotor has five teeth or furthermore a rotor pair geometry in which the main rotor has five teeth and the secondary rotor has six teeth. For different areas of application or intended uses, rotor pairs or screw machines having different tooth number ratios are possibly used. For example, rotor pair arrangements having a tooth number ratio of 4/5 (main rotor with four teeth, secondary rotor with five teeth) are used as a suitable pair for oil-injected compression applications in moderate pressure ranges.

In this respect, the tooth number or the tooth number ratio predefines different types of rotor pairs and resulting from this, different types of screw machines, in particular screw compressors.

For a screw machine or a rotor pair with three teeth in the main rotor and four teeth in the secondary rotor, a geometry having the following specifications is claimed, which can be deemed to be particularly energy-efficient:

A relative profile depth of the secondary rotor is configured with $$PT_{rel} = \frac{rk_1 - rf_1}{rk_1}$$

where $PT_{rel}$ is at least 0.5, preferably at least 0.515, and at most 0.65, preferably at most 0.595, wherein $rk_1$ is an addendum circle radius drawn around the outer circumference of the secondary rotor and $rf_1$ is a dedendum circle radius starting at the profile base of the secondary rotor. Furthermore, the ratio of the axis distance a of the first axis C1 from the second axis C2 and the addendum circle radius $rk_1$ $$\frac{a}{rk_1}$$

is specified so that $$\frac{a}{rk_1}$$

is at least 1.636 and at most 1.8, preferably at most 1.733, wherein preferably the main rotor is configured with a wrap-around angle $\phi_{HR}$ for which it holds that $240° \leq \phi_{HR} \leq 360°$, and wherein preferably for a rotor length ratio $L_{HR}/a$ it holds that:

$$1.4 \leq L_{HR}/a \leq 3.4,$$

wherein the rotor length ratio is formed from the ratio of the rotor length $L_{HR}$ of the main rotor and the axis distance a and the rotor length $L_{HR}$ of the main rotor is formed by the distance of a suction-side main-rotor rotor end face to an opposite pressure-side main-rotor rotor end face.

For a screw machine or a rotor pair with four teeth in the main rotor and five teeth in the secondary rotor, a geometry having the following specifications is claimed, which can be deemed to be particularly energy-efficient: a relative profile depth of the secondary rotor is configured with $$PT_{rel} = \frac{rk_1 - rf_1}{rk_1}$$

wherein $PT_{rel}$ is at least 0.5, preferably at least 0.515, and at most 0.58, wherein $rk_1$ is an addendum circle radius drawn around the outer circumference of the secondary rotor and $rf_1$ is a dedendum circle radius starting at the profile base of the secondary rotor. Furthermore the ratio of the axis distance a of the first axis C1 from the second axis C2 and the addendum circle radius $rk_1$ $$\frac{a}{rk_1}$$

is specified so that $$\frac{a}{rk_1}$$

is at least 1.683 and at most 1.836, preferably at most 1.782, wherein preferably the main rotor is configured with a wrap-around angle $\phi_{HR}$ for which it holds that $240° \leq \phi_{HR} \leq 360°$, and wherein preferably for a rotor length ratio $L_{HR}/a$ it holds that:

$$1.4 \leq L_{HR}/a \leq 3.3,$$

wherein the rotor length ratio is formed from the ratio of the rotor length $L_{HR}$ of the main rotor and the axis distance a and the rotor length $L_{HR}$ of the main rotor is formed by the distance of a suction-side main-rotor rotor end face to an opposite pressure-side main-rotor rotor end face.

For a screw machine or a rotor pair with five teeth in the main rotor and six teeth in the secondary rotor, a geometry having the following specifications is claimed, which can be deemed to be particularly energy-efficient:

A relative profile depth of the secondary rotor is configured with $$PT_{rel} = \frac{rk_1 - rf_1}{rk_1}$$

wherein $PT_{rel}$ is at least 0.44 and at most 0.495, preferably at most 0.48, wherein $rk_1$ is an addendum circle radius drawn around the outer circumference of the secondary rotor and $rf_1$ is a dedendum circle radius starting at the profile base of the secondary rotor. Furthermore the ratio of the axis distance a of the first axis C1 from the second axis C2 and the addendum circle radius $rk_1$ $$\frac{a}{rk_1}$$

is specified so that $$\frac{a}{rk_1}$$

is at least 1.74, preferably at least 1.75 and at most 1.8, preferably at most 1.79, wherein preferably the main rotor is configured with a wrap-around angle $\phi_{HR}$ for which it holds that $240° \leq \phi_{HR} \leq 360°$, and wherein preferably for a rotor length ratio $L_{HR}/a$ is holds that:

$$1.4 \leq L_{HR}/a \leq 3.2,$$

wherein the rotor length ratio is formed from the ratio of the rotor length $L_{HR}$ of the main rotor and the axis distance a and the rotor length $L_{HR}$ of the main rotor is formed by the distance of a suction-side main-rotor rotor end face to an opposite pressure-side main-rotor rotor end face.

If the values for the relative profile depth on the one hand and the ratio of axis distance to the addendum circle radius of the secondary rotor on the other hand for the given teeth-number ratios lie in the specified advantageous ranges in each case, the basic conditions for a good secondary rotor profile or a good cooperation of the secondary rotor profile and main rotor profile are created, in particular a particularly favourable ratio of blow hole area to profile gap length is made possible. With regard to the definitive parameters, reference is additionally made to the illustration in FIG. 7*a* for all the addressed tooth number ratios. The relative profile depth of the secondary rotor is a measure for how deeply the profiles are cut. With increasing profile depth, the installation volume utilization increases for example but at the expense of the flexural rigidity of the secondary rotor. For the relative profile depth of the secondary rotor it holds that:

$$PT_{rel} = \frac{rk_1 - rf_1}{rk_1} = \frac{PT_1}{rk_1} = \frac{rk_1 - (a - rk_2)}{rk_1} = 1 - \frac{a - rk_2}{rk_1}$$

where $PT_1 = rk_1 - rf_1$ and $rf_1 = a - rk_2$.

In this respect, there is a relationship with the ratio of $$\frac{a}{rk_1},$$

axis distance a to the secondary rotor addendum circle radius $rk_1$.

The specified values for the rotor length ratio $L_{HR}/a$ and the wrap-around angle $\phi_{HR}$ constitute advantageous or expedient values for the respectively given tooth number ratio in order to specify an advantageous rotor pair in the axial dimension.

1. Preferred Embodiments for a Rotor Pair with a Tooth Number Ratio of 3/4

Preferred embodiments are set out hereinafter for a rotor pair with a tooth number ratio 3/4, i.e. for a rotor pair in which the main rotor has three teeth and the secondary rotor has four teeth:

A first preferred embodiment provides that in a transverse sectional view, circular arcs $B_{25}$, $B_{50}$, $B_{75}$ running within a secondary rotor tooth are defined, the common centre point of which is given by the axis C1, wherein the radius $r_{25}$ of $B_{25}$ has the value $r_{25} = rf_1 + 0.25*(rk_1 - rf_1)$, the radius $r_{50}$ of $B_{50}$ has the value $r_{50} = rf_1 + 0.5*(rk_1 - rf_1)$, and the radius $r_{75}$ of $B_{75}$ has the value $r_{75} = rf_1 + 0.75*(rk_1 - rf_1)$, and wherein the circular arcs $B_{25}$, $B_{50}$, $B_{75}$ are each delimited by the leading tooth flank $F_V$ and trailing tooth flank $F_N$, wherein tooth thickness ratios are defined as ratios of the arc lengths $b_{25}$, $b_{50}$, $b_{75}$ of the circular arcs $B_{25}$, $B_{50}$, $B_{75}$ with $\varepsilon_1 = b_{50}/b_{25}$ and $\varepsilon_2 = b_{75}/b_{25}$ and the following dimension is adhered to: $0.65 \leq \varepsilon_1 < 1.0$ and/or $0.50 \leq \varepsilon_2 \leq 0.85$, preferably $0.80 \leq \varepsilon_1 < 1.0$ and/or $0.50 \leq \varepsilon_2 \leq 0.79$.

The aim is to combine a small blow hole with short length of the profile engagement gap. However the two parameters behave in a contrary manner, i.e. the smaller the blow hole is modelled, the larger the length of the profile engagement gap necessarily becomes. Conversely the blow hole becomes larger, the shorter is the length of the profile engagement gap. In the claimed ranges a particularly favourable combination of the two parameters is achieved. At the same time a sufficiently high flexural rigidity of the secondary rotor is achieved. Furthermore, advantages are established as far as the chamber expulsion is concerned and for the secondary rotor torque. With regard to the illustration of the parameters, reference is additionally made to FIG. 7*c*.

A further preferred embodiment provides that in a transverse sectional view, foot points F1 and F2 are defined between the observed tooth of the secondary rotor (NR) and the respectively adjacent tooth of the secondary rotor and an apex point F5 is defined at the radially outermost point of the tooth, wherein a triangle $D_z$ is defined by F1, F2 and F5 and wherein in a radially outer region, the tooth projects beyond the triangle $D_z$ with its leading tooth flank $F_V$ formed between F5 and F2 with an area A1 and with its trailing tooth flank $F_N$ formed between F1 and F5 with an area A2 and wherein $8 \leq A2/A1 \leq 60$ is maintained.

The tooth sub-area A1 at the leading tooth flank FV of the secondary rotor has a substantial influence on the blow hole area. The tooth sub-area A2 at the trailing tooth flank FN of the secondary rotor on the other hand has a substantial influence on the length of the profile engagement gap, the chamber expulsion and the secondary rotor torque. For the tooth sub-area ratio A2/A1 there is an advantageous range which enables a good compromise between length of the profile engagement gap on the one hand and the blow hole on the other hand. With regard to the illustration of the parameters, reference is additionally made to FIG. 7*d*.

In a further preferred embodiment the rotor pair comprises a secondary rotor in which in a transverse sectional view, foot points F1 and F2 are defined between the observed tooth of the secondary rotor (NR) and the respectively adjacent tooth of the secondary rotor, and an apex point F5 is defined at the radially outermost point of the tooth, wherein a triangle D2 is defined by F1, F2 and F5 and wherein in a radially outer region of the tooth, the leading tooth flank $F_V$ formed between F5 and F2 projects with an area A1 beyond the triangle $D_z$ and in a radially inner region is set back with respect to the triangle D, with an area A3 and wherein $7.0 \leq A3/A1 \leq 35$ is maintained. With regard to the illustration of the parameters, reference is additionally made to FIG. 7*d*.

Furthermore, with regard to the configuration of the secondary rotor, it is considered to be advantageous if in a transverse sectional view, foot points F1 and F2 are defined between the observed tooth of the secondary rotor (NR) and the respectively adjacent tooth of the secondary rotor (NR) and an apex point F5 is defined at the radially outermost point of the tooth, wherein a triangle $D_z$ is defined by F1, F2 and F5 and wherein in a radially outer region of the tooth, the leading tooth flank $F_V$ formed between F5 and F2 projects with an area A1 beyond the triangle $D_z$ and wherein the tooth itself has a cross-sectional area A0 delimited by the circular arc B running between F1 and F2 about the centre point defined by the axis C1 and wherein $0.5\% \leq A1/A0 \leq 4.5\%$ is maintained. With regard to the illustration of the parameters, reference is additionally made to FIGS. 7*d* and 7*c*.

A further preferred embodiment provides that in a transverse sectional view, foot points F1 and F2 are defined between the observed tooth of the secondary rotor (NR) and the respectively adjacent tooth of the secondary rotor and an apex point F5 is defined is defined at the radially outermost point of the tooth, wherein the circular arc B running between F1 and F2 defines a tooth partition angle $\gamma$ corresponding to 360°/number of teeth of the secondary rotor (NR) about the centre point defined by the axis C1, wherein a point F11 is defined on the half circular arc B between F1 and F2, wherein a radial half-line R drawn from the centre point of the secondary rotor (NR) defined by the axis C1 through the apex point F5 intersects the circular arc B at a point F12, wherein an offset angle $\varepsilon$ is defined by the offset of F11 to F12 viewed in the direction of rotation of the secondary rotor (NR) and wherein $14\% \leq \delta \leq 25\%$ is maintained, where $$\delta = \frac{\beta}{\gamma} * 100[\%].$$

Firstly it is again clarified that the offset angle is preferably always positive, i.e. the offset is always given in the direction of the direction of rotation and not contrary to this. In this respect the tooth of the secondary rotor is curved with respect to the axis of rotation of the secondary rotor. However, the offset should be kept in a range specified as advantageous in order to enable a favourable compromise between the blow hole area, the shape of the engagement line, the length and the shape of the profile engagement gap, the secondary rotor torque, the flexural rigidity of the rotors and the chamber expulsion into the pressure window. With regard to the illustration of the parameters, reference is additionally made to FIG. 7*f*.

It is considered to be advantageous if in a transverse sectional view, the trailing tooth flank $F_N$ of a tooth of the secondary rotor (NR) formed between F1 and F5 has a convex length component of at least 45% to at most 95%.

The relatively long convex length component of the trailing tooth flank $F_N$ of a tooth of the secondary rotor specified with the range allows a good compromise between length of the profile engagement gap, chamber expulsion, secondary rotor torque on the one hand and flexural rigidity of the secondary rotor on the other hand. With regard to the illustration of the parameters, reference is additionally made to FIG. 7*g*.

Preferably the secondary rotor is configured in such a manner that in a transverse sectional view, the radial half-line drawn from the axis C1 of the secondary rotor (NR) through F5 divides the tooth profile into an area component A5 assigned to the leading tooth flank $F_V$ and an area component A4 assigned to the trailing tooth flank $F_N$ and wherein $$5 \leq A4/A5 \leq 14$$

is maintained. It should be noted once again at this point that the tooth profile is delimited radially inwards towards the C1 axis by the dedendum circle $FK_1$. In this case, it can occur that the radial half-line R divides the tooth profile in such a manner that two disjoint area components with a total area component A5 which are assigned to the leading tooth flank $F_V$ are formed, cf. FIG. 7*g*. If the apex point F5 were to be offset with respect to the leading tooth flank in such a manner that the radial half-line F5 not only touches the leading tooth flank $F_V$ but intersects it at two points, two disjoint area components assigned to the leading tooth flank with a total area component A5 are again defined. The area component A4 assigned to the trailing tooth flank $F_N$ is then delimited on the one hand by the radial half-line R, in sections, namely between the two points of intersection of the leading tooth flank $F_V$ with the radial half-line, on the other hand by the leading tooth flank $F_V$.

A further preferred embodiment comprises a rotor pair which is characterized in that the main rotor HR is formed with a wrap-around angle $\phi_{HR}$ for which it holds that: $290° \leq \phi_{HR} \leq 360°$, preferably $320° \leq \phi_{HR} \leq 360°$.

With increasing wrap-around angle, the pressure window area can be configured to be larger for the same built-in volume ratio. In addition, the axial extension of the working chamber to be expelled, the so-called profile pocket depth, is shortened. This reduces the expulsion throttle losses in particular at higher rotational speeds and thus enables a better specific performance. A too-large wrap-around angle in turn has a disadvantageous effect on the installation volume and results in larger rotors.

In addition, in an advantageous embodiment a rotor pair is provided which is configured in such a manner and interacts with one another so that a blow hole factor $\mu_{B1}$ is at least 0.02% and at most 0.4%, preferably at most 0.25%, wherein $$\mu_{Bl} = \frac{A_{Bl}}{A6 + A7} * 100[\%]$$

and wherein $A_{B1}$ designates an absolute pressure-side blow hole area and A6 and A7 designate tooth gap areas of the secondary rotor (NR) or the main rotor (HR), wherein the area A6 in a transverse sectional view is the area enclosed between the profile course of the secondary rotor (NR) between two adjacent apex points F5 and the addendum circle $KK_1$ and the area A7 in a transverse sectional view is the area enclosed between the profile course of the main rotor (HR) between two adjacent apex points H5 and the addendum circle $KK_2$.

Whereas the absolute magnitude of the pressure-side blow hole alone does not allow any meaningful prediction about the effect on leakage mass flows, a ratio of the absolute pressure-side blow hole area $A_{B1}$ to the sum of the tooth gap area A6 of the secondary rotor and the tooth gap area A7 of the main rotor is substantially more predictive. With regard to the further illustration of the parameters, reference is additionally made here to FIG. 7*b*. The lower the numerical value of $\mu_{B1}$, the smaller is the influence of the blow hole on the operating behaviour. The pressure-side blow hole area can thus be represented independently of the installation size of the screw machine.

In a further preferred embodiment, a rotor pair is configured and matched to one another in such a manner that for a blow hole/profile gap length factor $\mu_1 * \mu_{B1}$ it holds that $$0.1\% \leq \mu_1 * \mu_{B1} \leq 1.72\%$$

where $$\mu_l = \frac{l_{sp}}{PT_1},$$

where $l_{sp}$ designates the length of the profile engagement gap of a tooth gap of the secondary rotor and $PT_1$ designates the profile depth of the secondary rotor, where $PT_1 = rk_1 - rf_1$ and $$\mu_{Bl} = \frac{A_{Bl}}{A6 + A7} * 100[\%]$$

where $A_{B1}$ designates the absolute blow hole area and A6 and A7 designate the profile areas of the secondary rotor (NR) or the main rotor (HR), wherein the area A6 in a transverse sectional view designates the area enclosed between the profile course of the secondary rotor (NR) between two adjacent apex points F5 and the addendum circle $KK_1$, and the area A7 in a transverse sectional view designates the area enclosed between the profile course of the main rotor (HR) between two adjacent apex points H5 and the addendum circle $KK_2$.

$\mu_1$ designates a profile gap length factor, where a length of the profile engagement gap of a tooth gap is related to the profile depth $PT_1$. Thus, a measure for the length of the profile engagement gap can be specified independently of the installation size of the screw machine, The lower the numerical value of the characteristic $\mu_1$, the shorter is the profile gap of a tooth pitch for the same profile depth and therefore the smaller is the leakage volume flow back to the suction side. The factor $\mu_1 * \mu_{B1}$ gives the aim of combining a small pressure-side blow hole with a short profile gap. As already mentioned however, the two characteristics behave in a contrary manner.

It is furthermore considered to be advantageous if main rotor (HR) and secondary rotor (NR) are configured and tuned to one another in such a manner that a dry compression with a pressure ratio $\Pi$ of up to 3, in particular with a pressure ratio $\Pi$ greater than 1 and up to 3 can be achieved, where the pressure ratio is the ratio of compression end pressure to suction pressure.

A further preferred embodiment provides a rotor pair in such a manner that the main rotor (HR) is configured to be operated relative to an addendum circle $KK_2$ at a circumferential speed in a range from 20 to 100 m/s.

A further embodiment provides a rotor pair which is characterized in that for a diameter ratio defined by the ratio of the addendum circle radii of main rotor (HR) and secondary rotor (NR)

$$D_v = \frac{Dk_2}{Dk_1} = \frac{rk_2}{rk_1}$$

$$1.145 \leq D_v \leq 1.30$$

is maintained, where $Dk_1$ designates the diameter of the addendum circle $KK_1$ of the secondary rotor (NR) and $Dk_2$ designates the diameter of the addendum circle $KK_2$ of the main rotor (HR).

2. Preferred Embodiments for a Rotor Pair with Tooth-Number Ratio of 4/5

Preferred embodiments are presented hereinafter for a rotor pair having a tooth number ratio of 4/5, i.e. for a rotor pair in which the main rotor has four teeth and the secondary rotor has five teeth:

A further preferred embodiment provides that in a transverse sectional view, circular arcs $B_{25}$, $B_{50}$, $B_{75}$ running within a secondary rotor tooth are defined, the common centre point of which is given by the axis C1, wherein the radius $r_{25}$ of $B_{25}$ has the value $r_{25} = rf_1 + 0.25*(rk_1 - rf_1)$, the radius $r_{50}$ of $B_{50}$ has the value $r_{50} = rf_1 + 0.5*(rk_1 - rf_1)$, and the radius $r_{75}$ of $B_{75}$ has the value $r_{75} = rf_1 + 0.75*(rk_1 - rf_1)$, and wherein the circular arcs $B_{25}$, $B_{50}$, $B_{75}$ are each delimited by the leading tooth flank $F_V$ and trailing tooth flank $F_N$, wherein tooth thickness ratios are defined as ratios of the arc lengths $b_{25}$, $b_{50}$, $b_{75}$ of the circular arcs $B_{25}$, $B_{50}$, $B_{75}$ with $\varepsilon_1 = b_{50}/b_{25}$ and $\varepsilon_2 = b_{75}/b_{25}$ and the following dimension is adhered to: $0.75 \leq \varepsilon_1 < 0.85$ and/or $0.65 \leq \varepsilon_2 \leq 0.74$.

The aim is to combine a small blow hole with short length of the profile engagement gap. However, the two parameters behave in a contrary manner, i.e. the smaller the blow hole is modelled, the larger the length of the profile engagement gap must necessarily be. Conversely, the blow hole becomes larger, the shorter the length of the profile engagement gap. In the claimed ranges a particularly favourable combination of the two parameters is achieved. At the same time, a sufficiently high flexural rigidity of the secondary rotor is ensured. Furthermore, advantages are obtained as regards the chamber expulsion and the secondary rotor torque. With regard to the illustration of the parameters, reference is additionally made to FIG. 7*c*.

A further preferred embodiment provides that in a transverse sectional view, foot points F1 and F2 are defined on the dedendum circle between the observed tooth of the secondary rotor (NR) and the respectively adjacent tooth of the secondary rotor and an apex point F5 is defined at the radially outermost point of the tooth, wherein a triangle $D_z$ is defined by F1, F2 and F5 and wherein in a radially outer region, the tooth projects beyond the triangle $D_z$ with its leading tooth flank $F_V$ formed between F5 and F2 with an area A1 and with its trailing tooth flank $F_N$ formed between F1 and F5 with an area A2 and wherein $6 \leq A2/A1 \leq 15$ is maintained.

The tooth sub-area A1 at the leading tooth flank $F_V$ of the secondary rotor has a substantial influence on the blow hole area. The tooth sub-area A2 at the trailing tooth flank $F_N$ of the secondary rotor on the other hand has a substantial influence on the length of the profile engagement gap, the chamber expulsion and the secondary rotor torque. For the tooth sub-area ratio A2/A1 there is an advantageous range which enables a good compromise between length of the profile engagement gap on the one hand and the blow hole on the other hand. With regard to the illustration of the parameters, reference is additionally made to FIG. 7*d*.

In a further embodiment, the rotor pair comprises a secondary rotor in which in a transverse sectional view, foot points F1 and F2 are defined between the observed tooth of the secondary rotor (NR) and the respectively adjacent tooth of the secondary rotor (NR), and an apex point F5 is defined at the radially outermost point of the tooth, wherein a triangle $D_z$ is defined by F1, F2 and F5 and wherein in a radially outer region of the tooth, the leading tooth flank $F_V$ formed between F5 and F2 projects with an area A1 beyond the triangle $D_z$ and in a radially inner region is set back with respect to the triangle $D_z$ with an area A3 and wherein $9.0 \leq A3/A1 \leq 18$ is maintained. With regard to the illustration of the parameters, reference is additionally made to FIG. 7*d*.

Furthermore with regard to the configuration of the secondary rotor, it is considered to be advantageous if in a transverse sectional view, foot points F1 and F2 are defined between the observed tooth of the secondary rotor (NR) and the respectively adjacent tooth of the secondary rotor (NR) and an apex point F5 is defined at the radially outermost point of the tooth, wherein a triangle $D_z$ is defined by F1, F2 and F5 and wherein in a radially outer region of the tooth, the leading tooth flank $F_V$ formed between F5 and F2 projects with an area A1 beyond the triangle $D_z$, wherein the tooth itself has a cross-sectional area A0 delimited by the circular arc B running between F1 and F2 about the centre point defined by the axis C1 and wherein $1.5\% \leq A1/A0 \leq 3.5\%$ is maintained.

With regard to the specification of the parameters, reference is made to FIGS. 7*d* and 7*e*.

A further preferred embodiment provides that in a transverse sectional view, foot points F1 and F2 are defined between the observed tooth of the secondary rotor (NR) and the respectively adjacent tooth of the secondary rotor (NR) and an apex point F5 is defined at the radially outermost point of the tooth, wherein the circular arc B running between F1 and F2 defines a tooth partition angle $\gamma$ corresponding to 360°/number of teeth of the secondary rotor (NR) about the centre point defined by the axis C1, wherein a point F11 is defined on the half circular arc B between F1 and F2, wherein a radial half-line R drawn from the centre point of the secondary rotor (NR) defined by the axis C1 through the apex point F5 intersects the circular arc B at a point F12, wherein an offset angle $\beta$ is defined by the offset of F11 to F12 viewed in the direction of rotation of the secondary rotor (NR) and wherein $$14\% \leq \delta \leq 18\%$$

is maintained where $$\delta = \frac{\beta}{\gamma} * 100[\%].$$

Firstly it is again clarified that the offset angle is preferably always positive, i.e. the offset is always given in the direction of the direction of rotation and not contrary to this. In this respect the tooth of the secondary rotor is curved with respect to the axis of rotation of the secondary rotor. However, the offset should be kept in a range specified as advantageous in order to enable a favourable compromise between the blow hole area, the shape of the engagement line, the length and the shape of the profile engagement gap, the secondary rotor torque, the flexural rigidity of the rotors and the chamber expulsion into the pressure window. With regard to the illustration of the parameters, reference is additionally made to FIG. 7*f*.

It is furthermore considered to be advantageous if in a transverse sectional view, the trailing tooth flank $F_N$ of a tooth of the secondary rotor (NR) formed between F1 and F5 has a convex length component of at least 55% to at most 95%.

The relatively long convex length component of the trailing tooth flank $F_N$ of a tooth of the secondary rotor specified with the range allows a good compromise between length of the profile engagement gap, chamber expulsion, secondary rotor torque on the one hand and flexural rigidity of the secondary rotor on the other hand. With regard to the illustration of the parameters, reference is additionally made to FIG. 7*g*.

Preferably the secondary rotor is configured such that in a transverse sectional view, the radial half-line drawn from the axis C1 of the secondary rotor (NR) through F5 divides the tooth profile into an area component A5 assigned to the leading tooth flank $F_V$ and an area component A4 assigned to the trailing tooth flank $F_N$ and wherein $$4 \leq A4/A5 \leq 9$$

is maintained. It should be noted once again at this point that the tooth profile is delimited radially inwards towards the C1 axis by the dedendum circle $FK_1$. In this case, it can occur that the radial half-line R divides the tooth profile in such a manner that two disjoint area components with a total area component A5 which are assigned to the leading tooth flank $F_V$ are formed, cf. FIG. 7*g*. If the apex point F5 were to be offset with respect to the leading tooth flank in such a manner that the radial half-line F5 not only touches the leading tooth flank $F_V$ but intersects it at two points, two disjoint area components assigned to the leading tooth flank with a total area component A5 are again defined. The area component A4 assigned to the trailing tooth flank $F_N$ is then delimited on the one hand by the radial half-line R, in sections, namely between the two points of intersection of the leading tooth flank $F_V$ with the radial half-line, on the other hand by the leading tooth flank $F_V$.

A further preferred embodiment comprises a rotor pair which is characterized in that the main rotor HR is formed with a wrap-around angle $\phi_{HR}$ for which it holds that: $320° \leq \phi_{HR} \leq 360°$, preferably $330° \leq \phi_{HR} \leq 360°$.

With increasing wrap-around angle, the pressure window area can be configured to be larger for the same built-in volume ratio. In addition, the axial extension of the working chamber to be expelled, the so-called profile pocket depth, is shortened. This reduces the expulsion throttle losses in particular at higher rotational speeds and thus enables a better specific performance. A too-large wrap-around angle in turn has a disadvantageous effect on the installation volume and results in larger rotors.

In addition, in an advantageous embodiment a rotor pair is provided which is configured in such a manner and interacts with one another so that a blow hole factor $\mu_{B1}$ is at least 0.02% and at most 0.4%, preferably at most 0.25%, wherein $$\mu_{Bl} = \frac{A_{Bl}}{A6 + A7} * 100[\%]$$

wherein $A_{B1}$ designates an absolute pressure-side blow hole area and A6 and A7 designate tooth gap areas of the secondary rotor (NR) or the main rotor (HR), wherein the area A6 in a transverse sectional view is the area enclosed between the profile course of the secondary rotor (NR) between two adjacent apex points F5 and the addendum circle $KK_1$ and the area A7 in a transverse sectional view is the area enclosed between the profile course of the main rotor (HR) between two adjacent apex points H5 and the addendum circle $KK_2$.

Whereas the absolute magnitude of the pressure-side blow hole alone does not allow any meaningful prediction about the effect on leakage mass flows, a ratio of the absolute pressure-side blow hole area $A_{B1}$ to the sum of the tooth gap area A6 of the secondary rotor and the tooth gap area A7 of the main rotor is substantially more predictive. With regard to the further illustration of the parameters, reference is additionally made here to FIG. 7*b*. The lower the numerical value of $\mu_{B1}$, the smaller is the influence of the blow hole on the operating behaviour. The pressure-side blow hole area can thus be represented independently of the installation size of the screw machine.

In a further preferred embodiment, a rotor pair is configured and matched to one another in such a manner that for a blow hole/profile gap length factor $\mu_1 * \mu_{B1}$ it holds that $$0.1\% \leq \mu_1 * \mu_{B1} \leq 1.72\%$$

where $$\mu_l = \frac{l_{sp}}{PT_1},$$

where $L_{sp}$ designates the length of the profile engagement gap of a tooth gap of the secondary rotor and $PT_1$ designates the profile depth of the secondary rotor where $PT_1 = rk_1 - rf_1$ and $$\mu_{Bl} = \frac{A_{Bl}}{A6 + A7} * 100[\%]$$

where $A_{B1}$ designates the absolute blow hole area and A6 and A7 designate the profile areas of the secondary rotor (NR) or the main rotor (HR), wherein the area A6 in a transverse sectional view designates the area enclosed between the profile course of the secondary rotor (NR) between two adjacent apex points F5 and the addendum circle $KK_1$, and the area A7 in a transverse sectional view designates the area enclosed between the profile course of the main rotor (HR) between two adjacent apex points H5 and the addendum circle $KK_2$.

$\mu_1$ designates a profile gap length factor, where a length of the profile engagement gap of a tooth gap is related to the profile depth $PT_1$. Thus, a measure for the length of the profile engagement gap can be specified independently of the installation size of the screw machine, The lower the numerical value of the characteristic $\mu_1$, the shorter is the profile gap for the same profile depth and therefore the smaller is the leakage volume flow back to the suction side. The factor $\mu_1 * \mu_{B1}$ gives the aim of combining a small pressure-side blow hole with a short profile gap. As already mentioned however, the two characteristics behave in a contrary manner.

It is furthermore considered to be advantageous if main rotor (HR) and secondary rotor (NR) are configured and tuned to one another in such a manner that a dry compression with a pressure ratio Π of up to 5, in particular with a pressure ratio Π greater than 1 and up to 5 can be achieved, or alternatively a fluid-injected compression with a pressure ratio Π of up to 16, in particular with a pressure ratio Π of greater than 1 and up to 16, where the pressure ratio is the ratio of compression end pressure to suction pressure.

A further preferred embodiment provides a rotor pair in such a manner that in the case of a dry compression the main rotor (HR) is configured to be operated relative to an addendum circle $KK_2$ at a circumferential speed in a range from 20 to 100 m/s and in the case of a fluid-injected compression the main rotor (HR) is configured to be operated relative to an addendum circle $KK_2$ at a circumferential speed in a range from 5 to 50 m/s.

A further embodiment comprises a rotor pair which is characterized in that for a diameter ratio defined by the ratio of the addendum circle radii of main rotor (HR) and secondary rotor (NR)

$$D_v = \frac{Dk_2}{Dk_1} = \frac{rk_2}{rk_1}$$

it holds that $$1.195 \leq D_v \leq 1.33$$

where $Dk_1$ designates the diameter of the addendum circle $KK_1$ of the secondary rotor (NR) and $Dk_2$ designates the diameter of the addendum circle $KK_2$ of the main rotor (HR).

3. Preferred Embodiments for a Rotor Pair with a Tooth Number Ratio of 5/6

Preferred embodiments are set out hereinafter for a rotor pair with a tooth number ratio 5/6, i.e. for a rotor pair in which the main rotor has five teeth and the secondary rotor has six teeth:

A first preferred embodiment provides that in a transverse sectional view, circular arcs $B_{25}$, $B_{50}$, $B_{75}$ running within a secondary rotor tooth are defined, the common centre point of which is given by the axis C1, wherein the radius $r_{25}$ of $B_{25}$ has the value $r_{25}=rf_1+0.25*(rk_1-rf_1)$, the radius $r_{50}$ of $B_{50}$ has the value $r_{50}=rf_1+0.5*(rk_1-rf_1)$, and the radius $r_{75}$ of $B_{75}$ has the value $r_{75}=rf_1+0.75*(rk_1-rf_1)$, and wherein the circular arcs $B_{25}$, $B_{50}$, $B_{75}$ are each delimited by the leading tooth flank $F_V$ and trailing tooth flank $F_N$, wherein tooth thickness ratios are defined as ratios of the arc lengths $b_{25}$, $b_{50}$, $b_{75}$ of the circular arcs $B_{25}$, $B_{50}$, $B_{75}$ with $\varepsilon_1=b_{50}/b_{25}$ and $\varepsilon_2=b_{75}/b_{25}$ and the following dimension is adhered to: $0.76\leq\varepsilon_1<0.86$ and/or $0.62\leq\varepsilon_2\leq0.72$.

The aim is to combine a small blow hole with short length of the profile engagement gap. However the two parameters behave in a contrary manner, i.e. the smaller the blow hole is modelled, the larger the length of the profile engagement gap necessarily becomes. Conversely the blow hole becomes larger, the shorter is the length of the profile engagement gap. In the claimed ranges a particularly favourable combination of the two parameters is achieved. At the same time a sufficiently high flexural rigidity of the secondary rotor is achieved. Furthermore, advantages are established as far as the chamber expulsion is concerned and for the secondary rotor torque. With regard to the illustration of the parameters, reference is additionally made to FIG. 7*c*.

A further preferred embodiment provides that in a transverse sectional view, foot points F1 and F2 are defined on the dedendum circle between the observed tooth of the secondary rotor (NR) and the respectively adjacent tooth of the secondary rotor and an apex point F5 is defined at the radially outermost point of the tooth, wherein a triangle $D_z$ is defined by F1, F2 and F5 and wherein in a radially outer region, the tooth projects beyond the triangle $D_z$ with its leading tooth flank $F_V$ formed between F5 and F2 with an area A1 and with its trailing tooth flank $F_N$ formed between F1 and F5 with an area A2 and wherein $4\leq A2/A1\leq7$ is maintained.

The tooth sub-area A1 at the leading tooth flank $F_V$ of the secondary rotor has a substantial influence on the blow hole area. The tooth sub-area A2 at the trailing tooth flank $F_N$ of the secondary rotor on the other hand has a substantial influence on the length of the profile engagement gap, the chamber expulsion and the secondary rotor torque. For the tooth sub-area ratio A2/A1 there is an advantageous range which enables a good compromise between length of the profile engagement gap on the one hand and the blow hole on the other hand. With regard to the illustration of the parameters, reference is additionally made to FIG. 7*d*.

In a further preferred embodiment, the rotor pair comprises a secondary rotor in which in a transverse sectional view, foot points F1 and F2 are defined between the observed tooth of the secondary rotor (NR) and the respectively adjacent tooth of the secondary rotor (NR) and an apex point F5 is defined at the radially outermost point of the tooth, wherein a triangle $D_z$ is defined by F1, F2 and F5 and wherein in a radially outer region of the tooth, the leading tooth flank $F_V$ formed between F5 and F2 projects with an area A1 beyond the triangle $D_z$ and in a radially inner region is set back with respect to the triangle $D_z$ with an area A3 and wherein $8.0\leq A3/A1\leq14$ is maintained. With regard to the illustration of the parameters, reference is additionally made to FIG. 7*d*.

Furthermore, with regard to the configuration of the rotor, it is considered to be advantageous if in a transverse sectional view, foot points F1 and F2 are defined between the observed tooth of the secondary rotor (NR) and the respectively adjacent tooth of the secondary rotor (NR) and an apex point F5 is defined at the radially outermost point of the tooth, wherein a triangle $D_z$ is defined by F1, F2 and F5 and wherein in a radially outer region of the tooth, the leading tooth flank $F_V$ formed between F5 and F2 projects with an area A1 beyond the triangle $D_Z$. wherein the tooth itself has a cross-sectional area A0 delimited by the circular arc B running between F1 and F2 about the centre point defined by the axis C1 and wherein $1.9\%\leq A1/A0\leq3.2\%$ is maintained. With regard to the illustration of the parameters, reference is additionally made to FIGS. 7*d* and 7*e*.

A further preferred embodiment provides that in a transverse sectional view, foot points F1 and F2 are defined between the observed tooth of the secondary rotor (NR) and the respectively adjacent tooth of the secondary rotor (NR) and an apex point F5 is defined at the radially outermost point of the tooth, wherein the circular arc B running between F1 and F2 defines a tooth partition angle $\gamma$ corresponding to 360°/number of teeth of the secondary rotor (NR) about the centre point defined by the axis C1, wherein a point F11 is defined on the half circular arc B between F1 and F2, wherein a radial half-line R drawn from the centre point of the secondary rotor (NR) defined by the axis C1 through the apex point F5 intersects the circular arc B at a point F12, wherein an offset angle $\beta$ is defined by the offset of F11 to F12 viewed in the direction of rotation of the secondary rotor (NR) and wherein $$13.5\%\leq\delta\leq18\%$$

is maintained where $$\delta=\frac{\beta}{\gamma}*100[\%].$$

Firstly it is again clarified that the offset angle is preferably always positive, i.e. the offset is always given in the direction of the direction of rotation and not contrary to this. In this respect the tooth of the secondary rotor is curved with respect to the axis of rotation of the secondary rotor. However, the offset should be kept in a range specified as advantageous in order to enable a favourable compromise between the blow hole area, the shape of the engagement line, the length and the shape of the profile engagement gap, the secondary rotor torque, the flexural rigidity of the rotors and the chamber expulsion into the pressure window. With regard to the illustration of the parameters, reference is additionally made to FIG. 7*f*.

A further preferred embodiment comprises a rotor pair which is characterized in that the main rotor HR is formed with a wrap-around angle $\phi_{HR}$ for which it holds that: $320°\leq\phi_{HR}\leq360°$, preferably $330°\leq\phi_{HR}\leq360°$. With increasing wrap-around angle, the pressure window area can be configured to be larger for the same built-in volume ratio. In addition, the axial extension of the working chamber to be expelled, the so-called profile pocket depth, is shortened. This reduces the expulsion throttle losses in particular at higher rotational speeds and thus enables a better specific performance. A too-large wrap-around angle in turn has a disadvantageous effect on the installation volume and results in larger rotors.

In addition, in an advantageous embodiment a rotor pair is provided which is configured in such a manner and interacts with one another so that a blow hole factor $\mu_{B1}$ is at least 0.03% and at most 0.25%, preferably at most 0.2%, wherein $$\mu_{Bl} = \frac{A_{Bl}}{A6 + A7} * 100[\%]$$

and wherein $A_{B1}$ designates an absolute pressure-side blow hole area and A6 and A7 designate tooth gap areas of the secondary rotor (NR) or the main rotor (HR), wherein the area A6 in a transverse sectional view is the area enclosed between the profile course of the secondary rotor (NR) between two adjacent apex points F5 and the addendum circle $KK_1$ and the area A7 in a transverse sectional view is the area enclosed between the profile course of the main rotor (HR) between two adjacent apex points H5 and the addendum circle $KK_2$.

Whereas the absolute magnitude of the pressure-side blow hole alone does not allow any meaningful prediction about the effect on leakage mass flows, a ratio of the absolute pressure-side blow hole area $A_{B1}$ to the sum of the tooth gap area A6 of the secondary rotor and the tooth gap area A7 of the main rotor is substantially more predictive. With regard to the further illustration of the parameters, reference is additionally made here to FIG. 7*b*. The lower the numerical value of $\mu_{B1}$, the smaller is the influence of the blow hole on the operating behaviour. The pressure-side blow hole area can thus be represented independently of the installation size of the screw machine.

In a further preferred embodiment, a rotor pair is configured and matched to one another in such a manner that for a blow hole/profile gap length factor $\mu_1 * \mu_{B1}$ it holds that $$0.1\% \leq \mu_1 * \mu_{B1} \leq 1.26\%$$

where $$\mu_l = \frac{l_{sp}}{PT_1},$$

where $L_{sp}$ designates the length of the profile engagement gap of a tooth gap of the secondary rotor and $PT_1$ designates the profile depth of the secondary rotor where $PT_1 = rk_1 - rf_1$ and $$\mu_{Bl} = \frac{A_{Bl}}{A6 + A7} * 100[\%]$$

where $A_{B1}$ designates the absolute blow hole area and A6 and A7 designate the profile areas of the secondary rotor (NR) or the main rotor (HR), wherein the area A6 in a transverse sectional view designates the area enclosed between the profile course of the secondary rotor (NR) between two adjacent apex points F5 and the addendum circle $KK_1$, and the area A7 in a transverse sectional view designates the area enclosed between the profile course of the main rotor (HR) between two adjacent apex points H5 and the addendum circle $KK_2$.

$\mu_1$ designates a profile gap length factor, where the length of the profile engagement gap of a tooth gap is related to the profile depth $PT_1$. Thus, a measure for the length of the profile engagement gap can be specified independently of the installation size of the screw machine. The lower the numerical value of the characteristic $\mu_1$, the shorter is the profile gap for the same profile depth and therefore the smaller is the leakage volume flow back to the suction side. The factor $\mu_1 * \mu_{B1}$ gives the aim of combining a small pressure-side blow hole with a short profile gap. As already mentioned however, the two characteristics behave in a contrary manner.

It is furthermore considered to be advantageous if main rotor (HR) and secondary rotor (NR) are configured and tuned to one another in such a manner that a dry compression with a pressure ratio Π of up to 5, in particular with a pressure ratio Π greater than 1 and up to 5 can be achieved, or alternatively a fluid-injected compression with a pressure ratio Π of up to 20, in particular with a pressure ratio Π of greater than 1 and up to 20, where the pressure ratio is the ratio of compression end pressure to suction pressure.

A further preferred embodiment provides a rotor pair in such a manner that in the case of a dry compression the main rotor (HR) is configured to be operated relative to an addendum circle $KK_2$ at a circumferential speed in a range from 20 to 100 m/s and in the case of a fluid-injected compression the main rotor (HR) is configured to be operated relative to an addendum circle $KK_2$ at a circumferential speed in a range from 5 to 50 m/s.

A further embodiment provides a rotor pair which is characterized in that for a diameter ratio defined by the ratio of the addendum circle radii of main rotor (HR) and secondary rotor (NR) it holds that $$D_v = \frac{Dk_2}{Dk_1} = \frac{rk_2}{rk_1}$$

$$1.19 \leq D_v \leq 1.26$$

where $Dk_1$ designates the diameter of the addendum circle $KK_1$ of the secondary rotor (NR) and $Dk_2$ designates the diameter of the addendum circle $KK_2$ of the main rotor (HR).

4. Preferred Embodiment for a Rotor Pair Having a Tooth-Number Ratio of 3/4, 4/5 or 5/6

It is generally considered to be preferable that in a transverse sectional view the teeth of the secondary rotor taper outwards, i.e. all circular arcs running perpendicular to a radial half-line starting from a centre point defined by the axis C1, drawn through the point F5, decrease radially outwards starting from the trailing tooth flank $F_N$ towards the leading tooth flank $F_V$ in the sequence from F1 to F2 (or at least remain the same in sections). In other words, in a transverse sectional view for all the arc lengths b(r), running inside a tooth of the secondary rotor, of the respectively appurtenant concentric circular arcs having the radius $rf_1 < r < rk_1$ and the common central point defined by the axis C1, which are each delimited by the leading tooth flank $F_V$ and the trailing tooth flank $F_N$, it holds that the arc lengths b(r) decrease monotonically with increasing radius r.

The teeth of the secondary rotor in this preferred embodiment are therefore configured in such a manner that no constrictions are obtained, i.e. the width of one tooth of the secondary rotor does not increase at any point but decreases radially outwards or remains at a maximum. This is considered to be appropriate in order to achieve on the one hand a small pressure-side blow hole with a nevertheless short profile engagement gap length.

Advantageously the transverse sectional configuration of the secondary rotor (NR) is executed in such a manner that the direction of action of the torque which results from a reference pressure on the partial surface of the secondary rotor delimiting the working chamber is directed contrary to the direction of rotation of the secondary rotor.

Such a transverse sectional configuration has the effect that the entire torque from the gas forces on the secondary rotor is directed contrary to the direction of rotation of the secondary rotor. As a result, a defined flank contact is achieved between the trailing secondary rotor flank $F_N$ and the leading main rotor flank. This helps to avoid the problem of so-called rotor rattling which can occur in unfavourable, in particular non-steady-state operating situations. Rotor rattling is understood to be an advancement and lagging of the secondary rotor superimposed on the uniform rotational movement about its axis of rotation which is accompanied by a rapidly changing impacting of the trailing secondary rotor flanks against the leading main rotor flanks and then of the leading secondary rotor flanks against the trailing main rotor flanks etc. This problem occurs in particular when the torque from the gas forces together with other torques (e.g. from bearing friction) on the secondary rotor is undefined (i.e. is close to zero, which is effectively avoided by the advantageous transverse sectional configuration.

In a specifically possible optional embodiment, main rotor (HR) and secondary rotor (NR) are configured and tuned to one another for conveying air or inert gases such as helium or nitrogen.

It is preferred that in a transverse sectional view, the profile of a tooth of the secondary rotor relative to the radial half-line R drawn from the centre point defined by the axis C1 through the apex point F5 is configured to be asymmetrical. In the secondary rotor therefore leading tooth flank and trailing tooth flank of each tooth are configured to be asymmetrical with respect to one another. This asymmetrical configuration is per se already known for screw compressors. However, it makes a substantial contribution to efficient compression.

A further preferred embodiment provides that in a transverse sectional view a point C is defined on the connecting section $\overline{C1C2}$ between the first axis (C1) and the second axis (C2) where the pitch circles $WK_1$ of the secondary rotor (NR) and $WK_2$ of the main rotor (HR) contact, that K5 defines the point of intersection of the dedendum circle $FK_1$ of the secondary rotor (NR) with the connecting section $\overline{C1C2}$, where $r_1$ determines the distance between K5 and C and that K4 designates the point of the suction-side part of the line of engagement which lies at the greatest distance from the connecting section $\overline{C1C2}$ between C1 and C2, where $r_2$ determines the distance between K4 and C and where it hold that:

$$0.9 \le \frac{r_1}{r_2} \le 0.875 \times \frac{z_1}{z_2} + 0.22$$

where $z_1$ is the number of teeth of the secondary rotor (NR) and $z_2$ is the number of teeth of the main rotor (HR).

Inter alia, the secondary rotor torque (=torque on the secondary rotor) and the chamber expulsion into the pressure window can be influenced by means of the profile of the suction-side part of the line of engagement between the straight-line section $\overline{C1C2}$ and the suction-side intersection edge. Characteristic features of the aforesaid profile of the suction-side part of the line of engagement can be described by means of the radii ratio $r_1/r_2$ of two concentric circles about the point C (=contact point of pitch circle $WK_1$ of the secondary rotor and pitch circle $WK_2$ of the main rotor). If the radii ratio $r_1/r_2$ lies within the specified range, the working chamber is expelled substantially completely into the pressure window.

In a preferred embodiment, the rotor pair is formed and configured in such a manner that for a rotor length ratio $L_{HR}/a$ it holds that: $0.85*(z_1/z_2)+0.67 \le L_{HR}/a \le 1.26*(z_1/z_2)+1.18$, preferably $0.89*(z_1/z_2)+0.94 \le L_{HR}/a \le 1.05*(z_1/z_2)+1.22$, where $z_1$ is the number of teeth of the secondary rotor (NR) and $z_2$ is the number of teeth of the main rotor (HR), wherein the rotor length ratio $L_{HR}/a$ gives the ratio of the rotor length $L_{HR}$ to the axial distance a and rotor length $L_{HR}$ is the distance of the suction-side main-rotor rotor end face to the pressure-side main-rotor rotor end face.

The lower the value of $L_{HR}/a$, the higher will be the flexural rigidity of the rotors (for the same displacement). In the claimed range the flexural rigidity of the rotors is sufficiently high so that the rotors do not bend significantly during operation and therefore the gap (between rotors or between rotors and compressor housing) can be designed to be relatively narrow without the risk thereby arising that the rotors run onto one another or run on in the compressor housing under unfavourable operating conditions (high temperatures and/or high pressures). Narrow gaps offer the advantage of low back flows and therefore contribute to the energy efficiency. At the same time, despite small gap dimensions, the operating safety is ensured. Also during rotor manufacture a high flexural rigidity of the rotors is advantageous for adhering to the high requirements for the shape tolerances.

On the other hand however, the ratio $L_{HR}/a$ is so large that the axial distance a is not excessively large in relation to the rotor length $L_{HR}$. This is advantageous since in consequence the rotor diameter and quite specifically the end faces of the rotors are not excessively large. As a result on the one hand, the gap lengths can be kept small; this results in a reduction of the back flow into preceding working chambers and as a result in turn improvement of the energy efficiency. On the other hand, as a result of small end face dimensions, the axial forces resulting from the pressurized pressure-side end faces of the rotors can advantageously be kept small, these axial forces act during operation on the rotors and in particular on the rotor mounting. By minimizing these axial forces, the loading of the (roller) bearings can be minimized or the bearings can have smaller dimensions.

It can advantageously be further provided that in a transverse sectional view the tooth profile of the secondary rotor (NR) on its radially outer section in sections follows a circular arc $ARC_1$ having the radius $rk_1$, i.e. a plurality of points of the leading tooth flank $F_V$ and the trailing tooth flank $F_N$ lie on the circular arc having the radius $rk_1$ around the centre point defined by the axis C1, wherein preferably the circular arc $ARC_1$ encloses an angle relative to the axis C1 between 0.5° and 5°. further preferably between 0.5° and 2.5°, wherein F10 is the point at the furthest distance from F5 on the leading tooth flank on this circular arc and wherein the radial half-line R10 drawn between F10 and the centre point of the secondary rotor (NR) defined by the axis C1 contacts the leading tooth flank $F_V$ at least at one point or at two points, cf. in particular the illustration in FIG. 7*h*.

The previously described embodiment of the tooth profile of the secondary rotor is primarily relevant for a tooth-number ratio of 3/4 or 4/5. With such a tooth-number ratio, the blow hole area can be reduced by satisfying the condition reproduced above. For the tooth-number ratio 5/6 on the other hand, an aforesaid contact point or aforesaid points of intersection with the leading tooth flank $F_V$, does not seem desirable since the teeth of the secondary rotor then possibly become too thin and in consequence too flexible.

Furthermore a compressor block comprising a compressor housing and a rotor pair as described previously is claimed according to the invention, wherein the rotor pair comprises a main rotor HR and a secondary rotor NR, which are each mounted rotatably in the compressor housing.

In a preferred embodiment, the compressor block is configured in such a manner that the transverse sectional configured is executed in such a manner that the working chamber formed between the tooth profiles of main rotor (HR) and secondary rotor (NR) can be expelled substantially completely into the pressure window.

In general it is also considered to be advantageous that with the selection of the profiles of secondary rotor and main rotor presented here it is possible to completely dispense with a pressure-relief groove/noise groove or to make this small.

As a result of the transverse sectional configuration of the two rotors, it is advantageously achieved that during expulsion of the working chambers into the pressure window, no chamber interstitial volume is formed between the two rotors. Compression can take place particularly efficiently since no back flow of already-compressed medium to the suction side takes place and with this no additional heat input accumulates. Furthermore, the entire compressed volume can be utilized by downstream compressed air users. As a result, over-compression is avoided, advantages are obtained for the energy efficiency, for the smooth running of the compressor block and for the lifetime of the rotor bearings. In oil-injected compressors, compression of the oil is prevented and thus the smooth running of the compressor is improved, the loading of the rotor mounting is reduced and the stressing of the oil is reduced.

In a further preferred embodiment a shaft end of the main rotor is guided out from the compressor housing and configured for connection to a drive, wherein preferably both shaft ends of the secondary rotor are accommodated completely inside the compressor housing.

BRIEF DESCRIPTION OF THE DRAWINGS

The invention is explained in further detail hereinafter with regard to further features and advantages by reference to the description of exemplary embodiments. In the figures.

DETAILED DESCRIPTION

Figure 1:
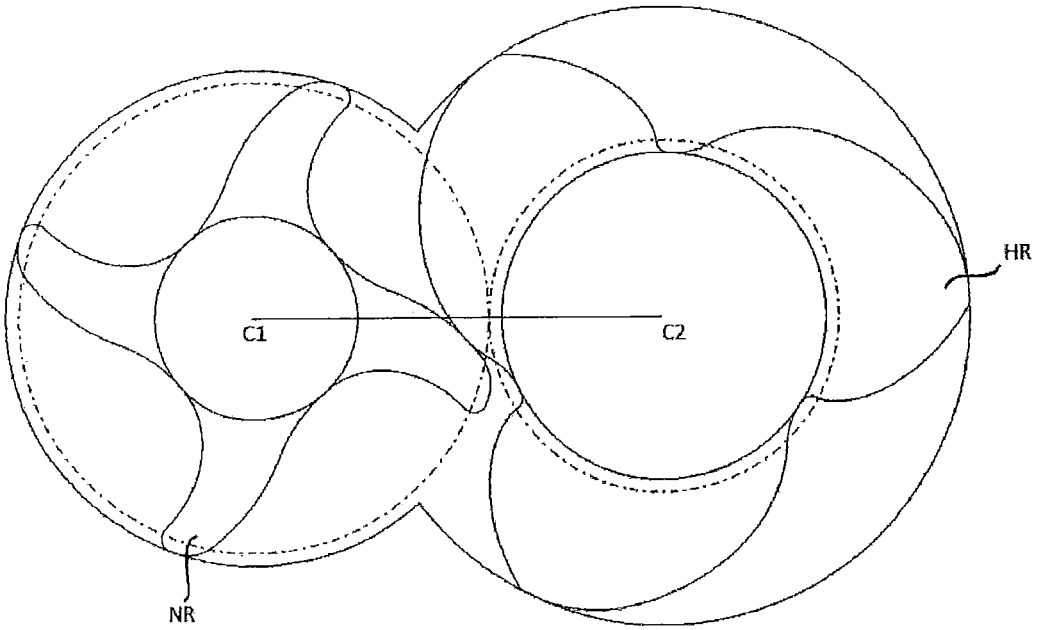
FIG. 1 shows a transverse section of a first embodiment with a tooth-number ratio of 3/4.
Figure 2:
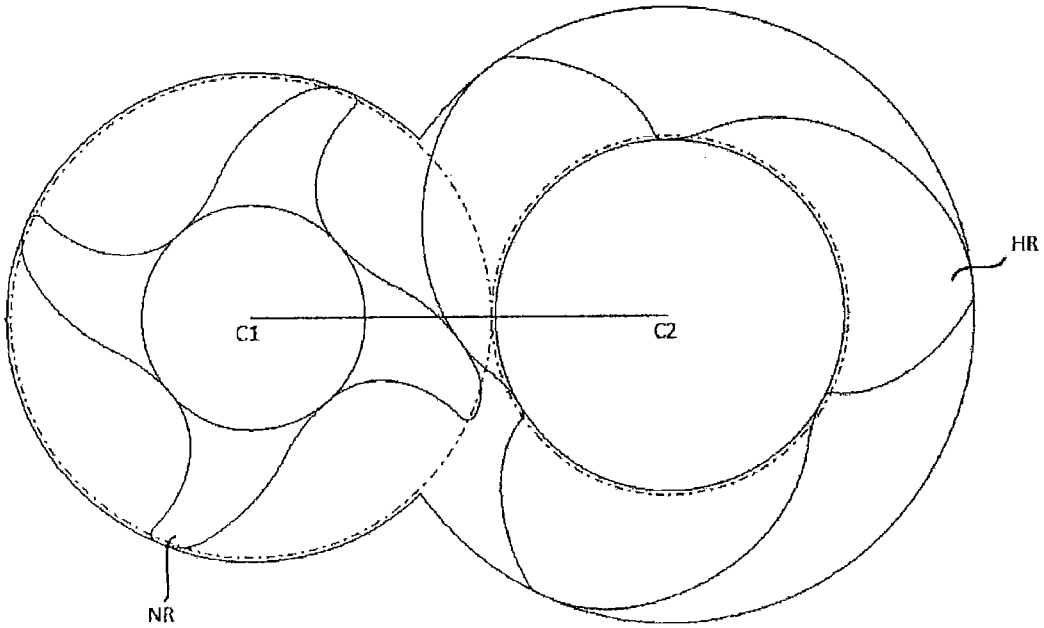
FIG. 2 shows a transverse section of a second embodiment with a tooth-number ratio of 3/4.
Figure 3:
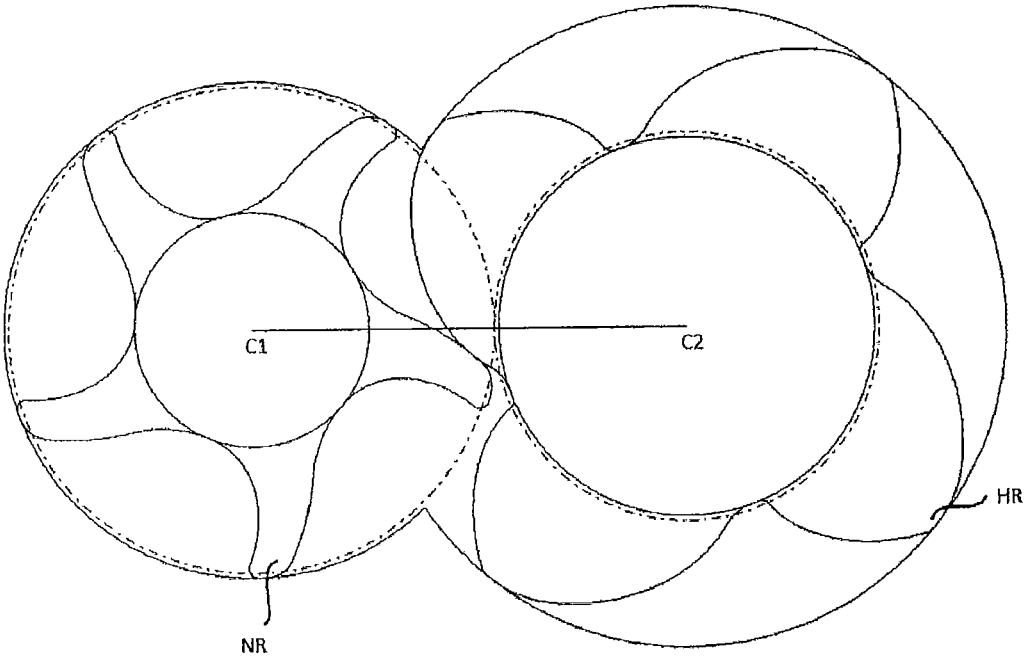
FIG. 3 shows a transverse section of a third embodiment with a tooth-number ratio of 4/5.
Figure 4:
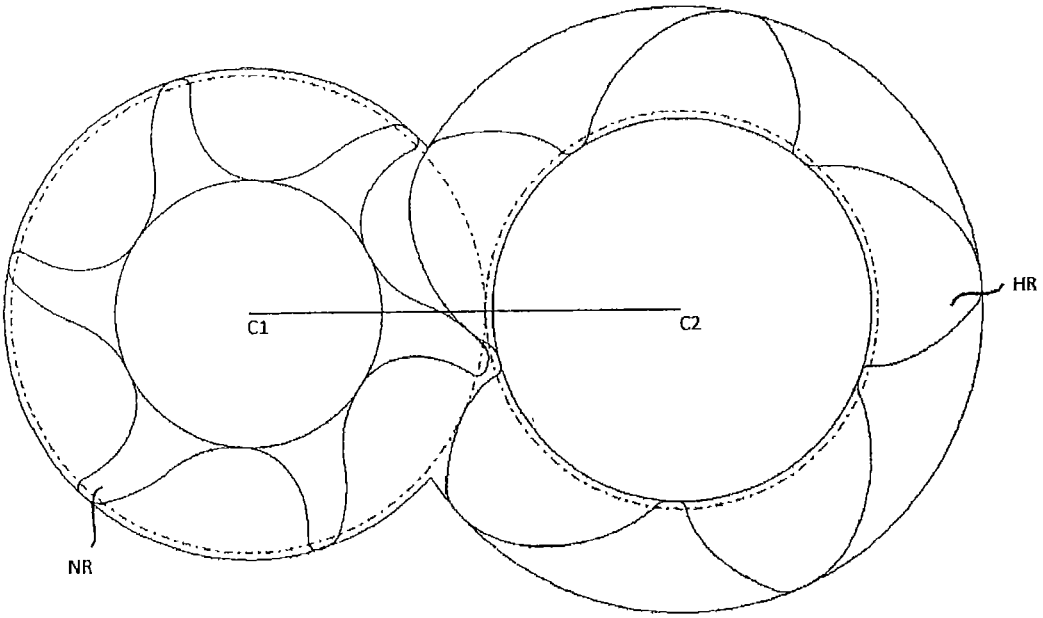
FIG. 4 shows a fourth exemplary embodiment in a transverse sectional view with a tooth number ratio of 5/6.

The exemplary embodiments according to FIGS. 1 to 4 will be explained hereinafter. All four exemplary embodiments represent suitable profiles in the sense of the present invention.

The corresponding geometrical specifications for the main rotor HR or the secondary rotor NR are given in Tables 1 to 4 reproduced hereinafter.

TABLE 1

| | Exemplary embodiment 1 | Exemplary embodiment 2 | Exemplary embodiment 3 | Exemplary embodiment 4 |
|---|---|---|---|---|
| Teeth number HR $z_2$ | 3 | 3 | 4 | 5 |
| Teeth number NR $z_1$ | 4 | 4 | 5 | 6 |
| $PT_{rel}$ [−] | 0.588 | 0.54 | 0.528 | 0.455 |
| $a/rk_1$ [−] | 1.66 | 1.72 | 1.764 | 1.78 |

TABLE 2

The profiles were created with the following axial distances a:

| | Exemplary embodiment 1 | Exemplary embodiment 2 | Exemplary embodiment 3 | Exemplary embodiment 4 |
|---|---|---|---|---|
| Axial distance a [mm] | | 127 | | 111 |

TABLE 3

Thus the following transverse-section principal dimensions are obtained:

| | Exemplary embodiment | Exemplary embodiment 2 | Exemplary embodiment 3 | Exemplary embodiment 4 |
|---|---|---|---|---|
| $Dk_2$ [mm] | 191 | 186.1 | 186 | 154 |
| $Dk_1$ [mm] | 153 | 147.7 | 144 | 124.7 |
| $rw_2$ [mm] | 54.4 | | 56.4 | 50.5 |
| $rw_1$ [mm] | 72.6 | | 70.6 | 60.5 |

TABLE 4

| Further principal dimensions of the rotors: | | | | |
|---|---|---|---|---|
| | Exemplary embodiment 1 | Exemplary embodiment 2 | Exemplary embodiment 3 | Exemplary embodiment 4 |
| Rotor length $L_{HR}$ [mm] | 307 | | 293 | 235.5 |

In the exemplary embodiments presented, the following features and characteristics according to the invention are obtained, which are presented in Table 5:

TABLE 5

| Compilation of the further features and characteristics: | | | | |
|---|---|---|---|---|
| Feature | Exemplary embodiment 1 | Exemplary embodiment 2 | Exemplary embodiment 3 | Exemplary embodiment 4 |
| Tooth thickness ratio $\varepsilon_1$ [−] | 0.85 | 0.82 | 0.80 | 0.79 |
| Tooth thickness ratio $\varepsilon_2$ [−] | 0.74 | 0.64 | 0.69 | 0.65 |
| Area ratio A2/A1 [−] | 15.7 | 37.8 | 10.0 | 6.2 |
| Area ratio A1/A0 [%] | 2.3 | 1.1 | 2.2 | 2.3 |
| Area ratio A3/A1 [−] | 9.9 | 19.6 | 12.6 | 11.6 |
| Tooth curvature ratio δ [%] | 18.5 | 21.1 | 15.7% | 15.2 |
| Convex length component [%] | 66.9% | 71.2% | 62.7% | — |
| Radial tooth thickness profile | The tooth thickness of the secondary rotor teeth decreases monotonically from the addendum circle radius $rf_1$ to the dedendum circle radius $rk_1$ | | | |
| Radial half-line $R_{10}$ | Radial half-line $R_{10}$ has two points of intersection with the leading tooth flank FV | | | |
| Area ratio A4/A5 [−] | 7.5 | 10.1 | 5.5 | — |
| Wrap-around angle $\Phi_{HR}$ | 334.7° | | 330.3 | 330.3 |
| $\mu_{B1}$ [%] | 0.159 | 0.086 | 0.106 | 0.18 |
| $\mu_{B1} * \mu_1$ [%] | 0.94 | 0.53 | 0.631 | 1.058 |
| Profile transverse sectional configuration in relation to chamber expulsion | The working chamber can be expelled substantially completely into the pressure window | | | |
| Profile transverse sectional configuration in relation to secondary rotor torque | The direction of action of the NR torque resulting from the gas forces is directed contrary to the direction of rotation of the secondary rotor | | | |
| Shape of engagement line $r_1/r_2$ | 1.037 | 1.044 | 0.984 | 1.0 |
| Diameter ratio Dv | 1.248 | 1.26 | 1.292 | 1.235 |
| Rotor length ratio $L_{HR}/a$ | 2.42 | 2.42 | 2.31 | 2.12 |

Figure 5:
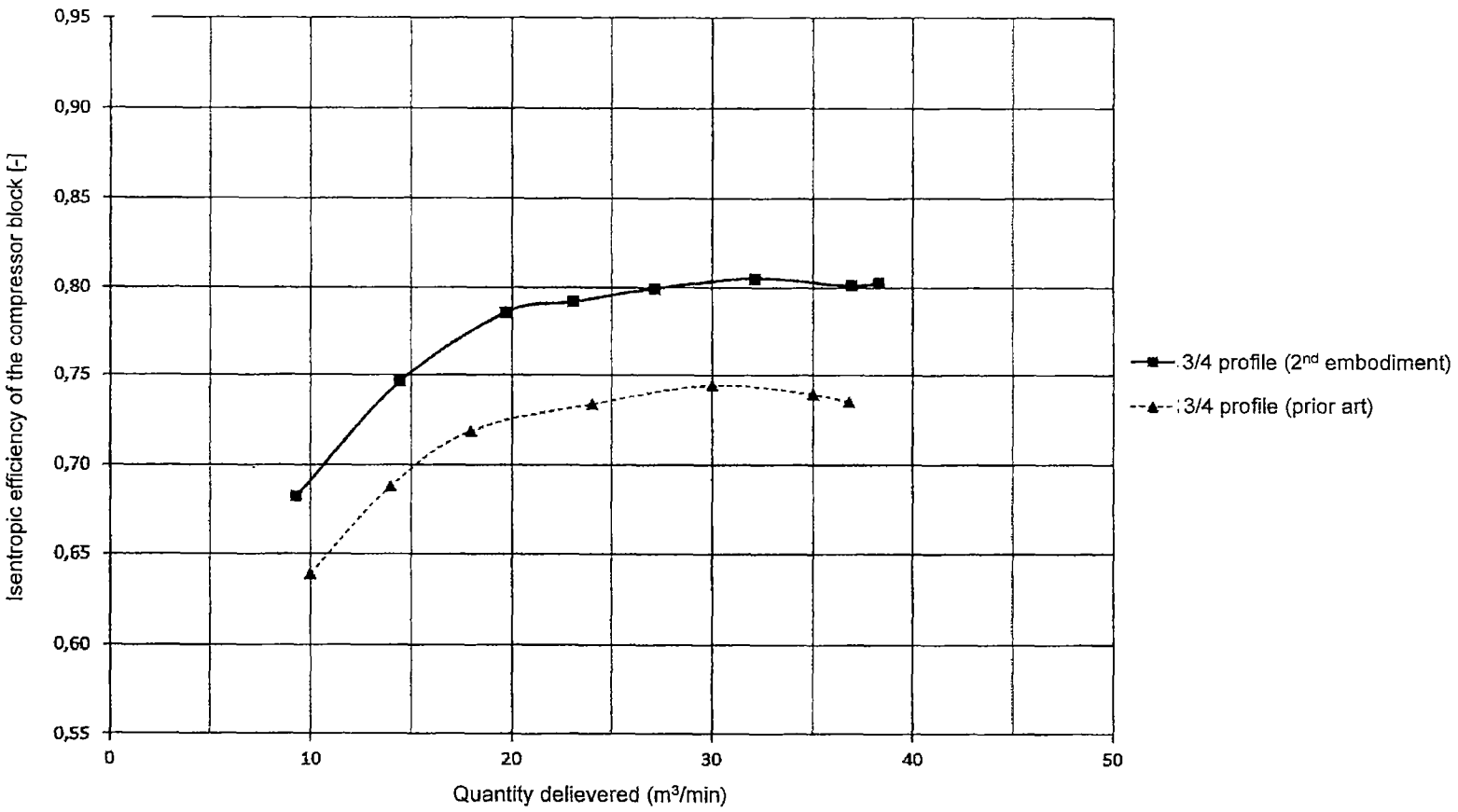
FIG. 5 shows an illustration of the isentropic block efficiency for the second exemplary embodiment for the 3/4 tooth-number ratio compared with the prior art.

The isentropic block efficiency compared to the prior art is illustrated for the second exemplary embodiment for the 3/4 tooth-number ratio in FIG. 5. Two curves for the same pressure ratio are reproduced there. The specifically reproduced pressure ratio is 2.0 (ratio of output pressure to input pressure). The isentropic block efficiency could be improved significantly compared with the values attainable with the prior art.

Figure 6:
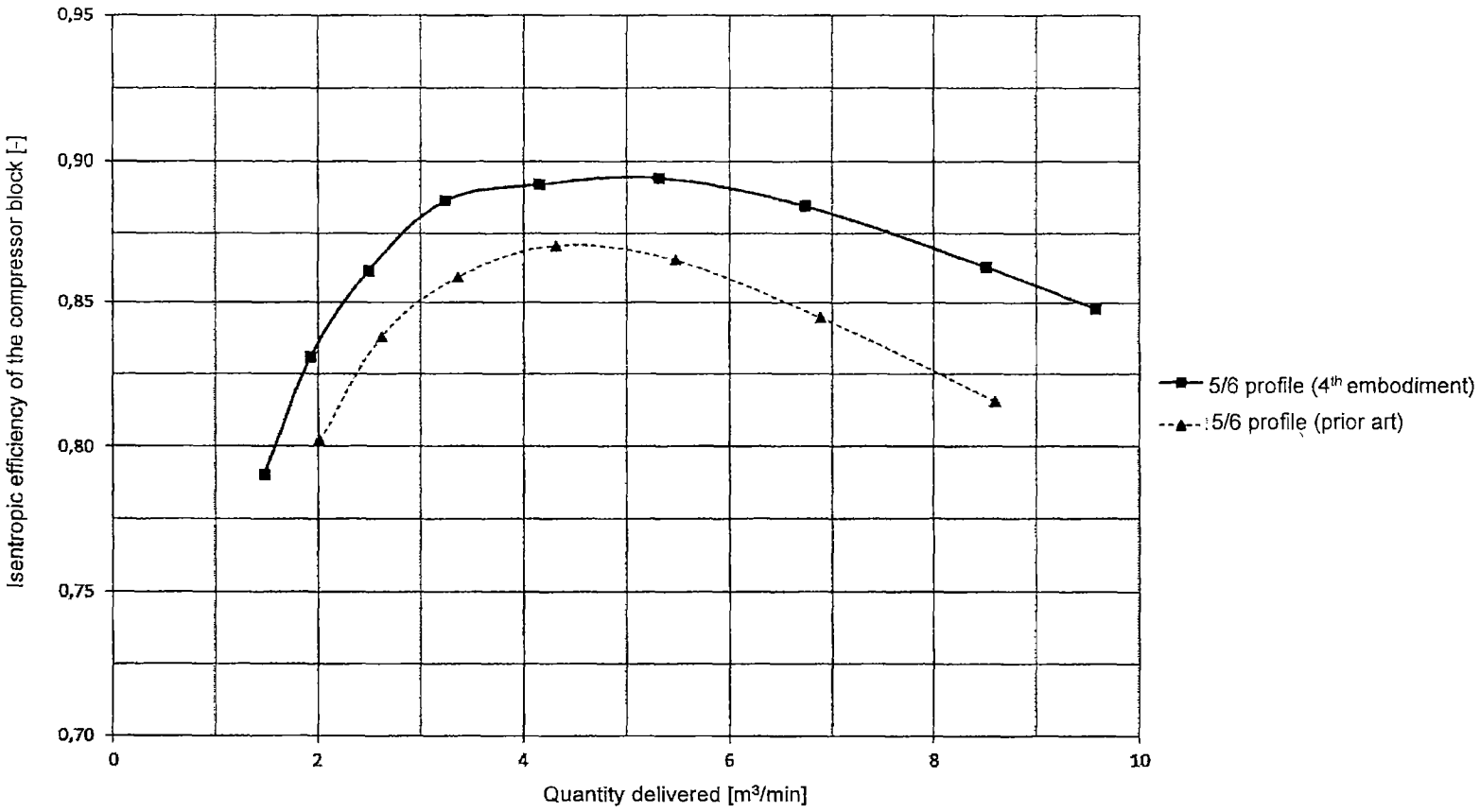
FIG. 6 shows an illustration of the isentropic block efficiency for the fourth exemplary embodiment for the 5/6 tooth-number ratio compared with the prior art.

FIG. 6 shows the isentropic block efficiency compared to the prior art for the fourth exemplary embodiment (5/6 tooth-number ratio). Two curves for the same pressure ratio are also reproduced here. The specifically reproduced pressure ratio is 9.0 (ratio of output pressure to input pressure). Here also the isentropic block efficiency could be improved significantly compared with the values attainable with the prior art.

The quantity delivered specified in each case in FIGS. 5 and 6 corresponds to the conveyed volume flow of the compressor block relative to the suction state.

Figure 7A:
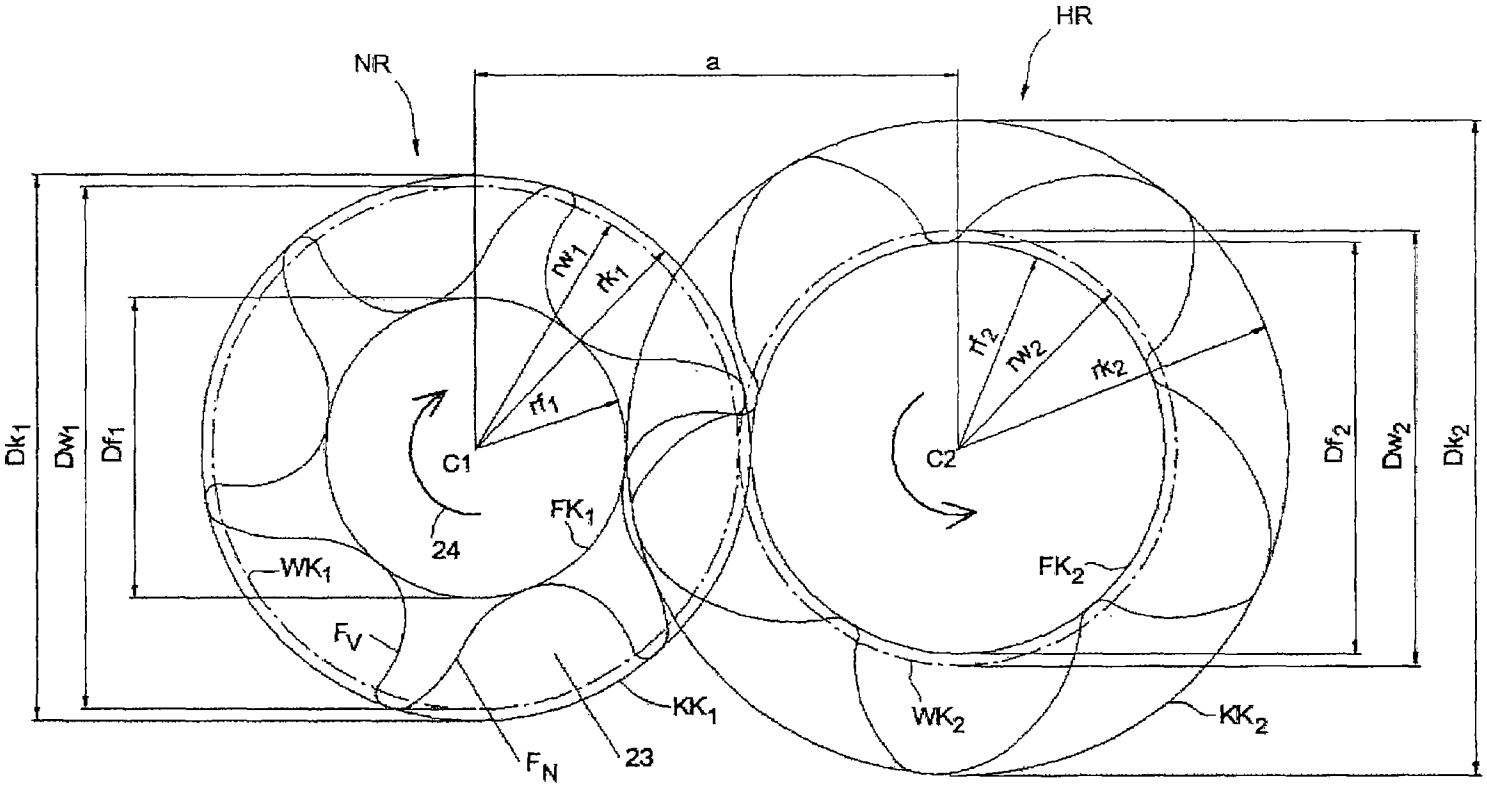
FIG. 7*a*-7*k* shows illustration diagrams for the various parameters of the geometry of the secondary rotor or the rotor pair consisting of main rotor and secondary rotor.

FIG. 7*a* shows in a transverse sectional view one embodiment for secondary rotor NR and main rotor HR with the centre points given by the corresponding axes C1 and C2. Furthermore, the geometrical principal dimensions or principal parameters of the transverse sectional view are shown:

- Addendum circle $KK_1$ of the secondary rotor with appurtenant addendum circle radius rk1 or addendum circle diameter $Dk_1$
- Addendum circle $KK_2$ of the main rotor with appurtenant addendum circle radius $rk_2$ or addendum circle diameter $Dk_2$
- Dedendum circle $FK_1$ of the secondary rotor with appurtenant dedendum circle radius $rf_1$ or dedendum circle diameter $Df_1$
- Dedendum circle $FK_2$ of the main rotor with appurtenant dedendum circle radius $rf_2$ or dedendum circle diameter $Df_2$
- Axial distance a between the first axis C1 and the second axis C2
- Pitch circle $WK_1$ of the secondary rotor with appurtenant pitch circle radius $rw_1$ or pitch circle diameter $Dw_1$
- Pitch circle $WK_2$ of the main rotor with appurtenant pitch circle radius $rw_2$ or pitch circle diameter $Dw_2$ Also shown are the direction of rotation 24 of the secondary rotor and the necessarily resulting direction of rotation of the main rotor during operation as a compressor.

The leading tooth flank $F_V$ and the trailing tooth flank $F_N$ are characterized on a secondary rotor tooth as representative for all teeth of the secondary rotor. A tooth gap 23 is characterized as representative of all tooth gaps of the secondary rotor. The profile course of the leading tooth flank $F_V$ and of the trailing tooth flank $F_N$ shown by reference to FIG. 7*a* corresponds to the exemplary embodiment for a tooth-number ratio of 5/6 illustrated by reference to FIG. 4.

Figure 7B:
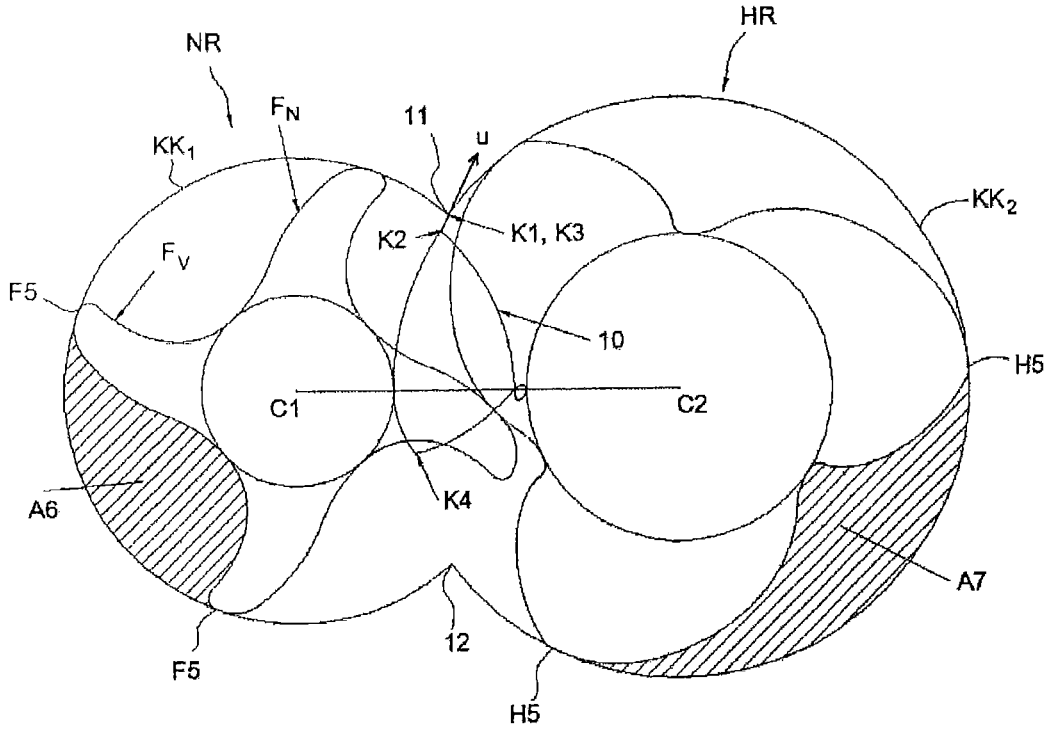

FIG. 7*b* shows in a transverse sectional view the tooth gap areas A6 and A7 as well as a side view of a blow hole. The profile courses shown in FIG. 7*b* to explain the tooth gap areas A6 and A7 correspond to the exemplary embodiment for a tooth number ratio of 3/4 illustrated by reference to FIG. 1.

Figure 7C:
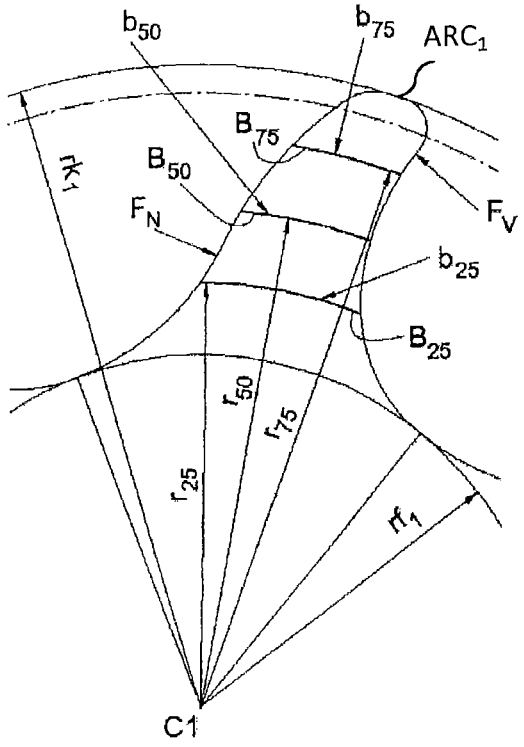
Figure 7D:
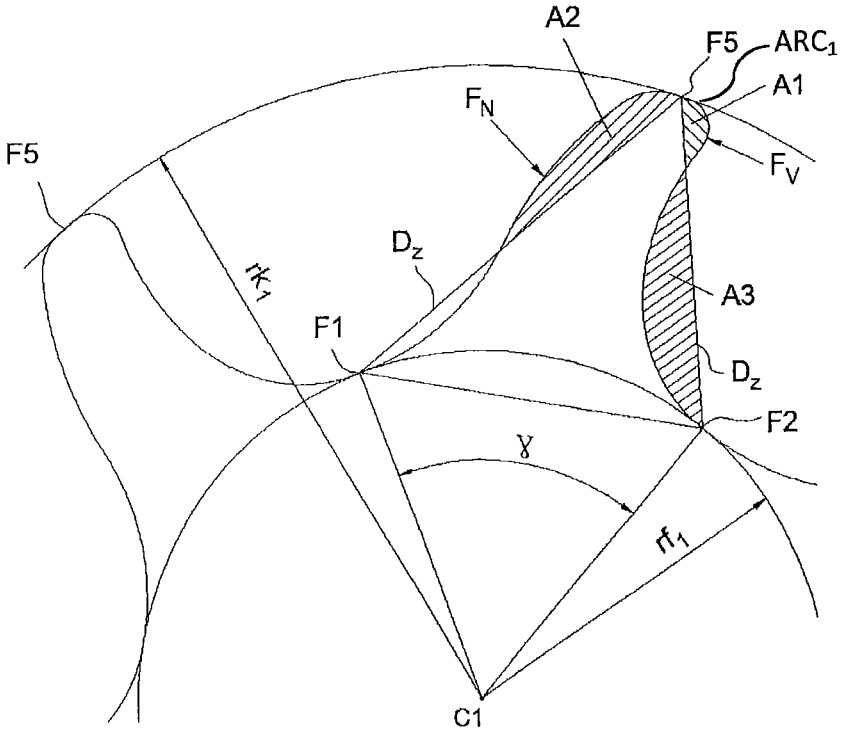
Figure 7E:
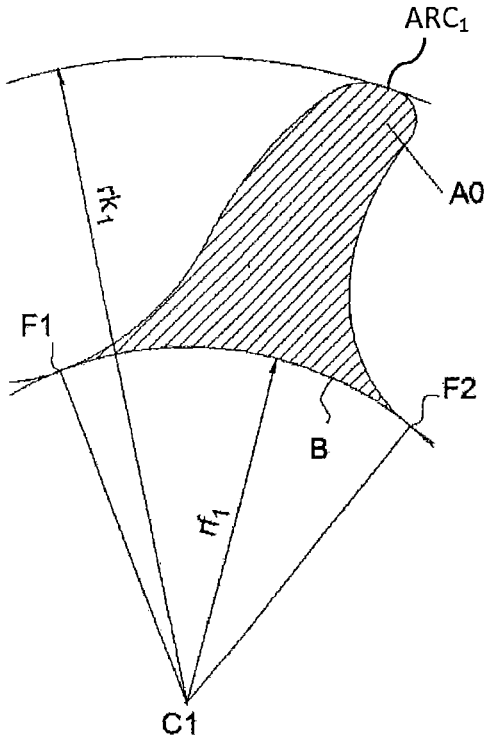
Figure 7F:
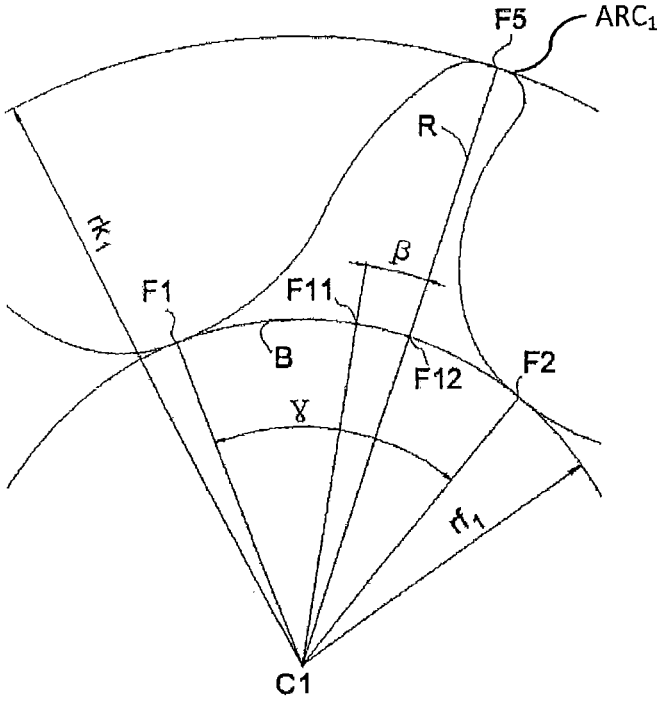
Figure 7G:
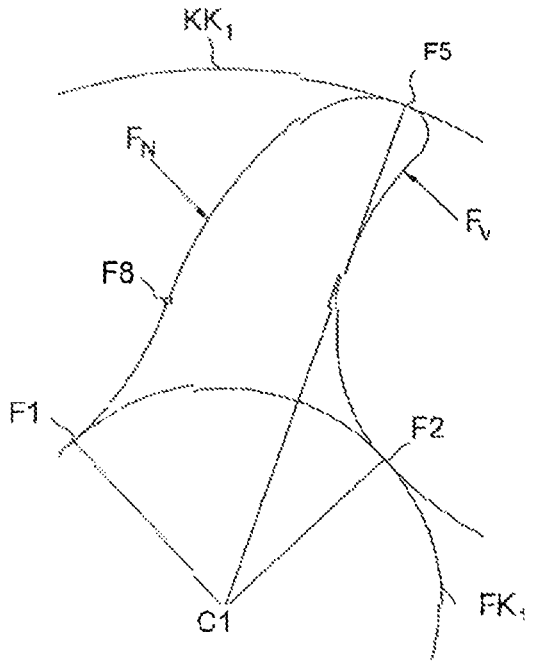
Figure 7H:
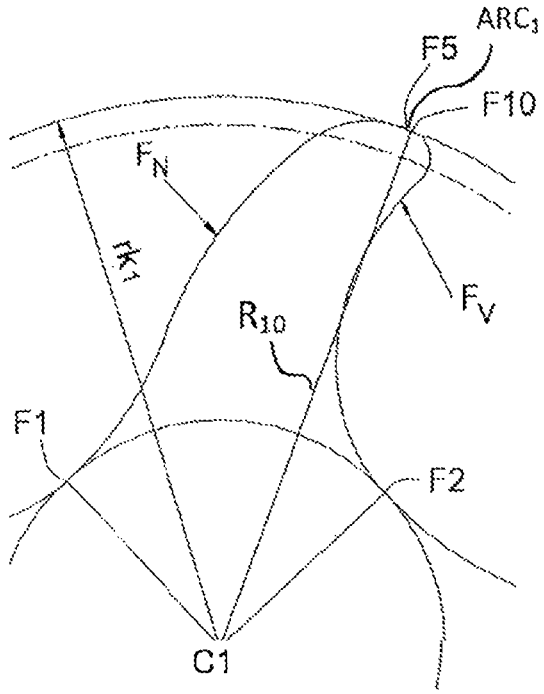
Figure 7I:
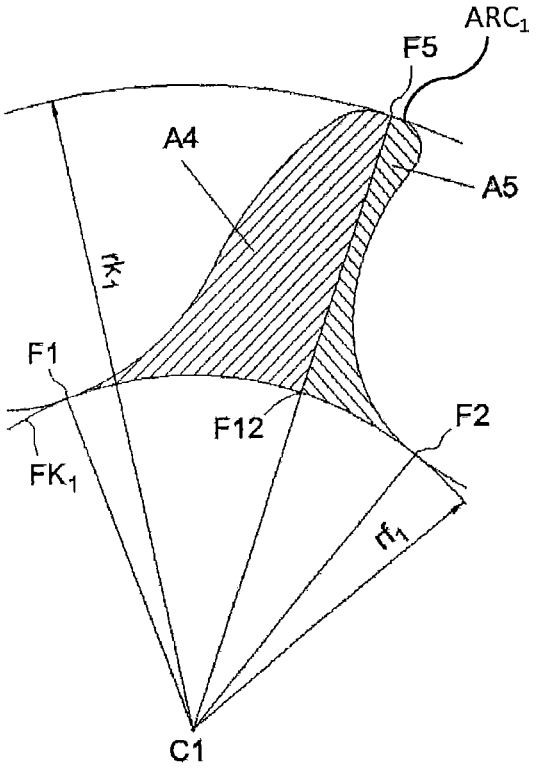
Figure 7J:
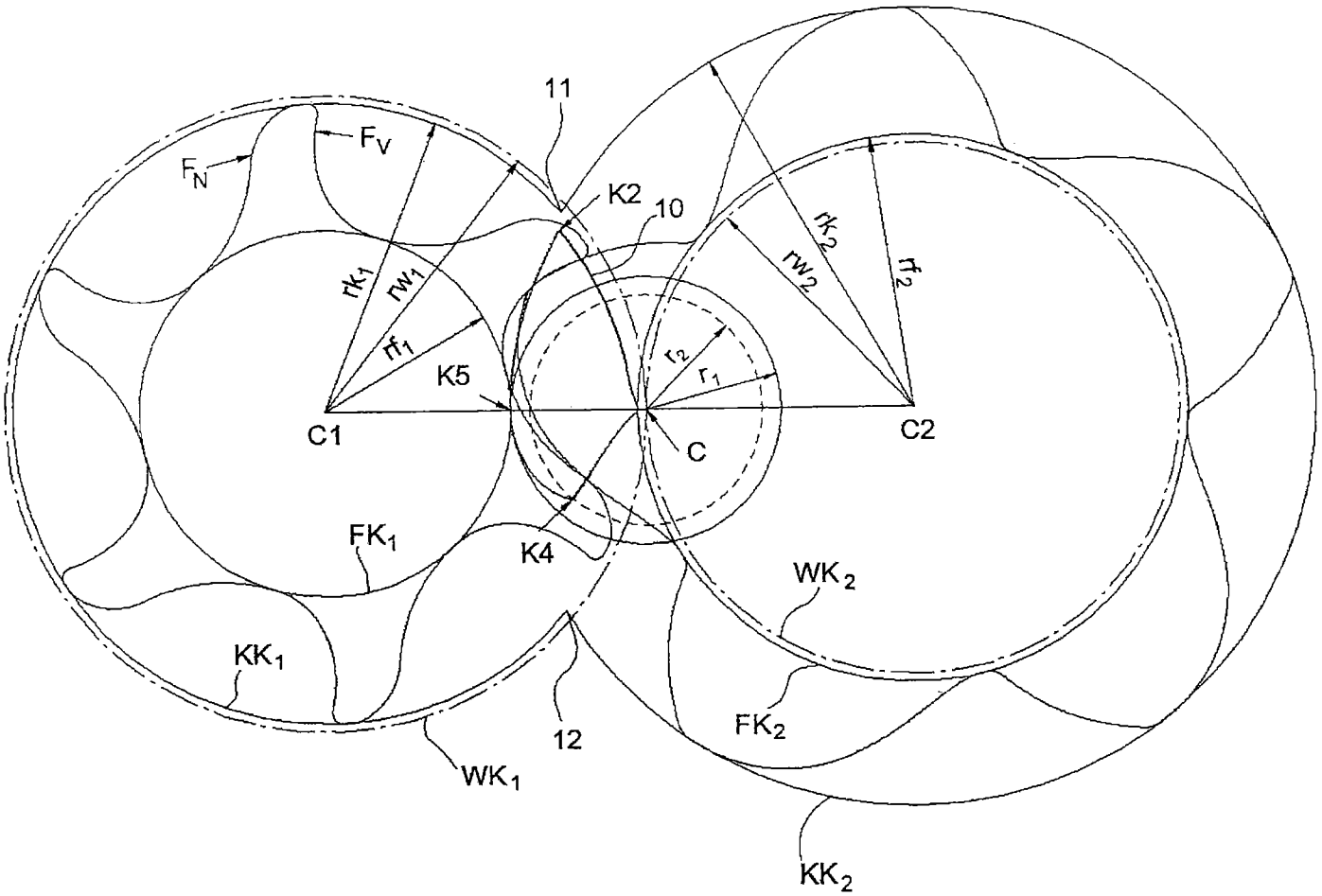
Figure 7K:
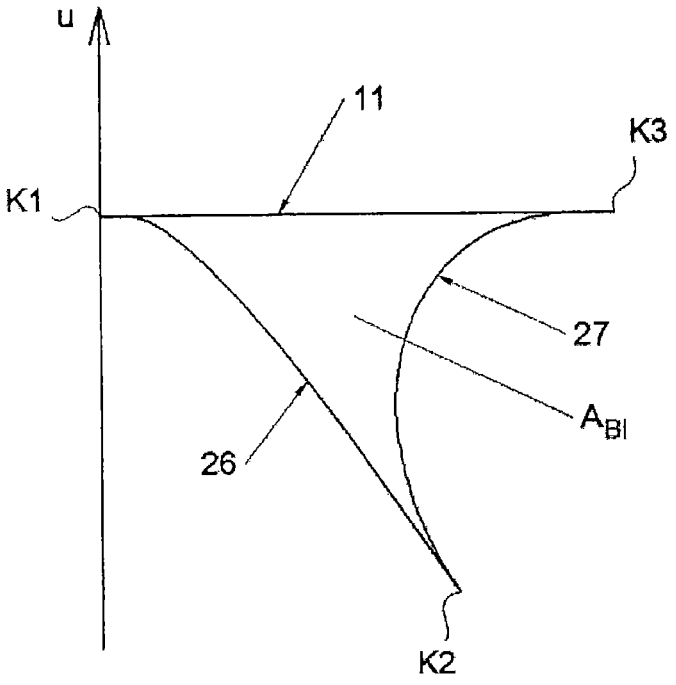

Furthermore, FIG. 7*b* shows the position of the coordinate system of the blow hole area $A_{B1}$ shown in FIG. 7*k* in relation to the rotor pair.

The coordinate system is spanned by the u-axis parallel to the rotor end faces along the pressure-side intersection edge 11.

The pressure-side blow hole lies in the described coordinate system and quite specifically in a plane perpendicular to the rotor end faces between the pressure-side intersection edge 11 and an engagement line point K2 of the pressure-side part of the line of engagement.

In a transverse sectional view the line of engagement 10 is divided into two sections by the connecting line between the two centre points C1 and C2: the suction-side part of the line of engagement is shown below, the pressure-side part is shown above the connecting line.

K2 designates the point of the pressure-side part of the line of engagement 10 which lies at the furthest distance from the straight lines through C1 and C2. As a result of the intersection of the addendum circles of the two rotors, a pressure-side intersection edge 11 and a suction-side intersection edge 12 are formed. In FIG. 7*b* the pressure-side intersection edge 11 is shown as a point in a transverse sectional view. The same applies to the depiction of the suction-side intersection edge 12.

The u-axis is a parallel to the rotor end faces and in a transverse sectional view corresponds to the vector from the engagement line point K2 to the pressure-side intersection edge 11. Further details on the pressure-side blow hole area $A_{B1}$ are obtained from FIG. 7*k*.

FIG. 7*c* shows in a transverse sectional view a tooth of the secondary rotor with the concentric circular arcs $B_{25}$, $B_{50}$, $B_{75}$ running inside the rotor tooth around the centre point C1 with the appurtenant radii $R_{25}$, $r_{50}$, $r_{75}$ and the appurtenant arc lengths $b_{25}$, $b_{50}$, $b_{75}$.

The circular arcs $B_{25}$, $B_{50}$, $B_{75}$ are in each case delimited by the leading tooth flank $F_V$ and the trailing tooth flank $F_N$. The profile course of the leading tooth flank $F_V$ and the trailing tooth flank $F_N$ shown by reference to FIG. 7*c* corresponds to the exemplary embodiment explained by reference to FIG. 4 for a tooth-number ratio of 5/6.

FIG. 7*d* shows in a transverse sectional view foot points F1 and F2 on the addendum circle between the observed tooth of the secondary rotor and the respectively adjacent tooth of the secondary rotor and an apex point F5 at the radially outermost point of the tooth. Furthermore, the triangle $D_z$ defined by the points F1, F2 and F5 is shown.

FIG. 7*d* shows the following (tooth sub-)areas:

Tooth sub-area A1 corresponds to the area with which the observed tooth projects with its leading tooth flank $F_V$ formed between F5 and F2 beyond the triangle $D_z$ in a radially outer region.

Tooth sub-area A2 corresponds to the area with which the observed tooth projects with its trailing tooth flank $F_N$ formed between F5 and F1 beyond the triangle $D_z$ in a radially outer region.

Area A3 corresponds to the area with which the observed tooth is set back with its leading tooth flank formed between F5 and F2 with respect to the triangle $D_z$.

Also shown is the tooth partition angle γ corresponding to 360°/number of teeth of the secondary rotor. The profile course of the leading tooth flank $F_V$ and the trailing tooth flank $F_N$ shown by reference to FIG. 7*d* corresponds to the exemplary embodiment explained by reference to FIG. 4 for a tooth-number ratio of 5/6.

FIG. 7*e* shows in a transverse sectional view the cross-sectional area A0 of a tooth of the secondary rotor which is delimited by the circular arc B running between F1 and F2 about the centre point C1. The profile course of the leading tooth flank $F_V$ and the trailing tooth flank $F_N$ shown by reference to FIG. 7*e* corresponds to the exemplary embodiment explained by reference to FIG. 4 for a tooth-number ratio of 5/6.

FIG. 7*f* shows in a transverse sectional view the offset angle β. This is defined by the offset from point F11 to point F12 observed in the direction of rotation of the secondary rotor. F11 is a point on the half circular arc B between F1 and F2 about the centre point C1 and consequently corresponds to the point of intersection of the angle bisector of the tooth partition angle γ with the circular arc B.

F12 is obtained from the point of intersection of the radial half-line R drawn from the centre point C1 to the apex point F5 with the circular arc B. The profile course of the leading tooth flank $F_V$ and the trailing tooth flank FN shown by reference to FIG. 7*f* corresponds to the exemplary embodiment explained by reference to FIG. 4 for a tooth-number ratio of 5/6.

FIG. 7*g* shows in a transverse sectional view the turning point F8 on the trailing tooth flank $F_N$ of the secondary rotor at which the curvature of the course of the tooth profile changes between addendum and dedendum circle.

The trailing tooth flank $F_N$ of the secondary rotor is divided by the point F8 into a substantially convexly curved component between F8 and the apex point F5 and a substantially concavely curved component between F8 and the foot point F1.

FIG. 7*h* shows in a transverse sectional view two points of intersection of the radial half-line R10 from C1 to F10 with the leading tooth flank $F_V$ of the secondary rotor, wherein the point F10 designates that point of the leading tooth flank $F_V$ which lies on the addendum circle $KK_1$ and is at the furthest distance from F5. The tooth flank therefore radially outwards over a defined section follows a circular arc ARC1 with radius $rk_1$ about the centre point of the secondary rotor defined by the axis C1. The profile courses of the leading tooth flank $F_V$ and the trailing tooth flank $F_N$ explained by reference to FIG. 7*h* correspond to the exemplary embodiment according to FIG. 1 for a tooth-number ratio of 3/4.

FIG. 7*i* shows in a transverse sectional view the tooth profile divided by the radial half-line drawn from C1 to F5.

Specifically in the embodiment shown, the tooth profile is divided into an area component A4 assigned to the trailing tooth flank $F_N$ and an area component A5 assigned to the leading tooth flank $F_V$. The profile courses of the leading tooth flank $F_V$ and the trailing tooth flank $F_N$ explained by reference to FIG. 7*i* correspond to the exemplary embodiment according to FIG. 4 described for a tooth-number ratio of 5/6.

FIG. 7*j* shows in a transverse sectional view the line of engagement 10 between main and secondary rotor as well as the two concentric circles about the point C having the radii $r_1$ and $r_2$ to describe the characteristic features of the course of the suction-side part of the line of engagement.

The line of engagement 10 is divided into two sections by the connecting section between the first axis C1 and the second axis C2: the suction-side part of the line of engagement is shown below, the pressure-side part is shown above the connecting section $\overline{C1C2}$.

Point C is the point of contact of the pitch circle WK1 of the secondary rotor with the pitch circle $WK_2$ of the main rotor.

K4 designates the point of the suction-side part of the line of engagement which lies at the greatest distance from the connecting section between C1 and C2.

Radius $r_1$ is the distance between K5 and C, radius $r_2$ designates the distance between K4 and C.

FIG. 7*k*

FIG. 7*k* shows a pressure-side blow hole area $A_{B1}$ of a working chamber and specifically in a sectional view perpendicular to the rotor end faces. The delimitation of the blow hole area $AB_1$ is formed here from the line of intersection 27 of the above-described imaginary flat surface with the leading secondary-rotor tooth flank $F_v$, the line of intersection 26 of the plane with the trailing HR flank and a straight line section [K1 K3] of the pressure-side intersection edge 11.

The coordinate system of the pressure-side blow hole lies in the flat surface described in FIG. 7*b* and is spanned by the u-axis parallel to the rotor end faces (vector from the engagement line point K2 to the pressure-side intersection edge 11) and the pressure-side intersection edge 11.

Figure 8:
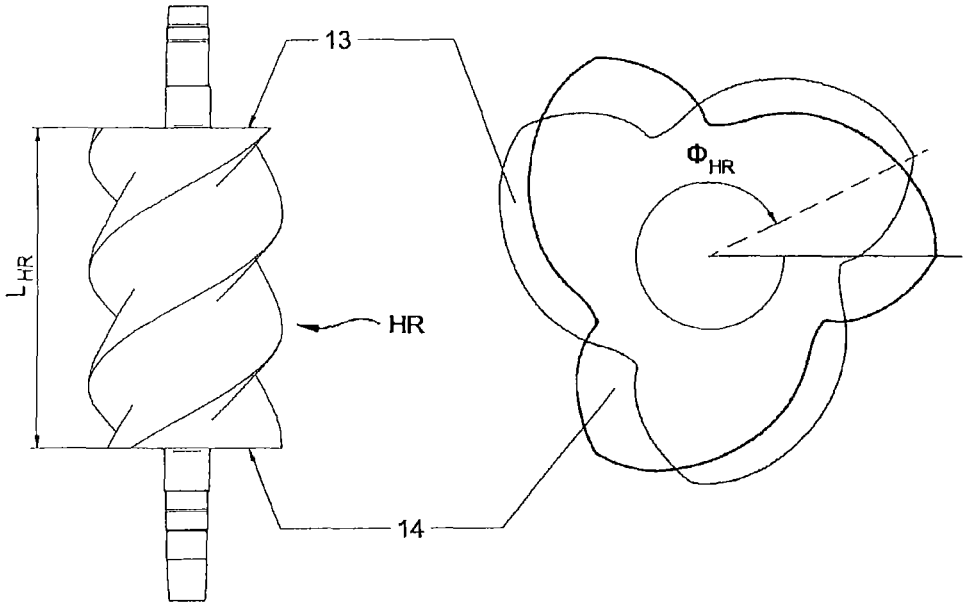
FIG. 8 shows an illustration of the wrap-around angle at the main rotor.

In FIG. 8 the wrap-around angle Φ already discussed several times is illustrated once again. Specifically this is the angle Φ through which the transverse section is turned from the suction-side to the pressure-side rotor end face. This is illustrated in the present case by the turning of the profile between a pressure-side end face 13 and a suction-side end face 14 through the angle $\Phi_{HR}$ at the main rotor HR.

Figure 9:
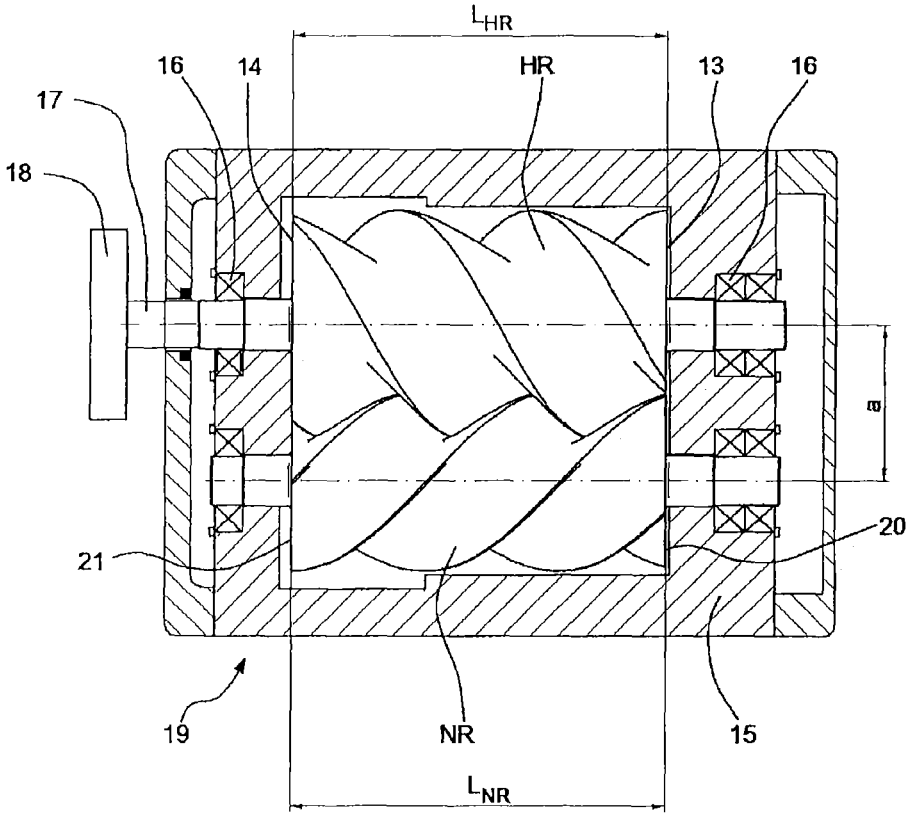
FIG. 9 shows a schematic sectional drawing of an embodiment of a compressor block.

FIG. 9 shows a schematic sectional view of a compressor block 19 comprising a housing 15 as well as two rotors toothed with one another in pairs, mounted therein, namely a main rotor HR and a secondary rotor NR. Main rotor HR and secondary rotor NR are each mounted rotatably in a housing 15 by means of suitable bearings 16. A drive power can be applied to a shaft 17 of the main rotor HR, for example with a motor (not shown) via a coupling 18.

The compressor block shown is an oil-injected screw compressor in which the torque transmission between main rotor HR and secondary rotor NR is accomplished directly by means of the rotor flanks. In contrast to this in a dry screw compressor any contact of the rotor flanks can be avoided by means of a synchronization transmission (not shown).

Also not shown are a suction connection for suction of the medium to be compressed and an outlet for the compressed medium.

Figure 10:
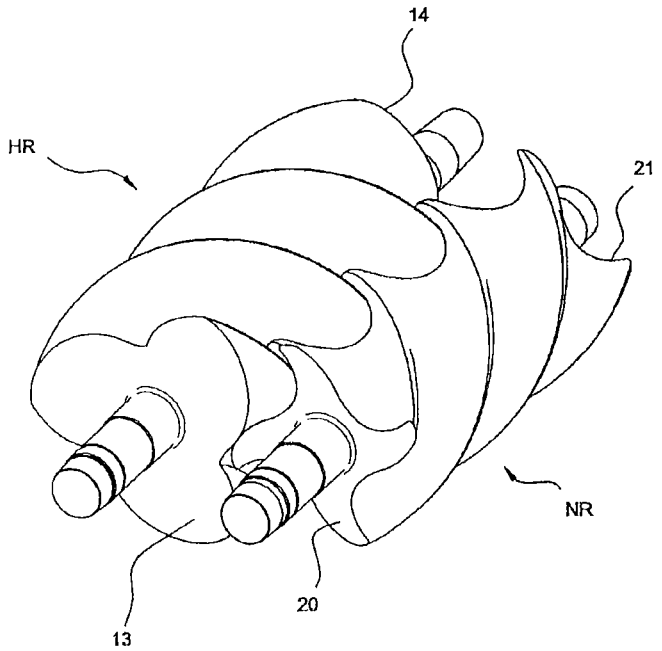
FIG. 10 shows an embodiment for an intermeshed rotor pair consisting of a main rotor and a secondary rotor in three-dimensional view.

FIG. 10 shows intermeshed main rotor HR and secondary rotor NR in a perspective view.

Figure 11:
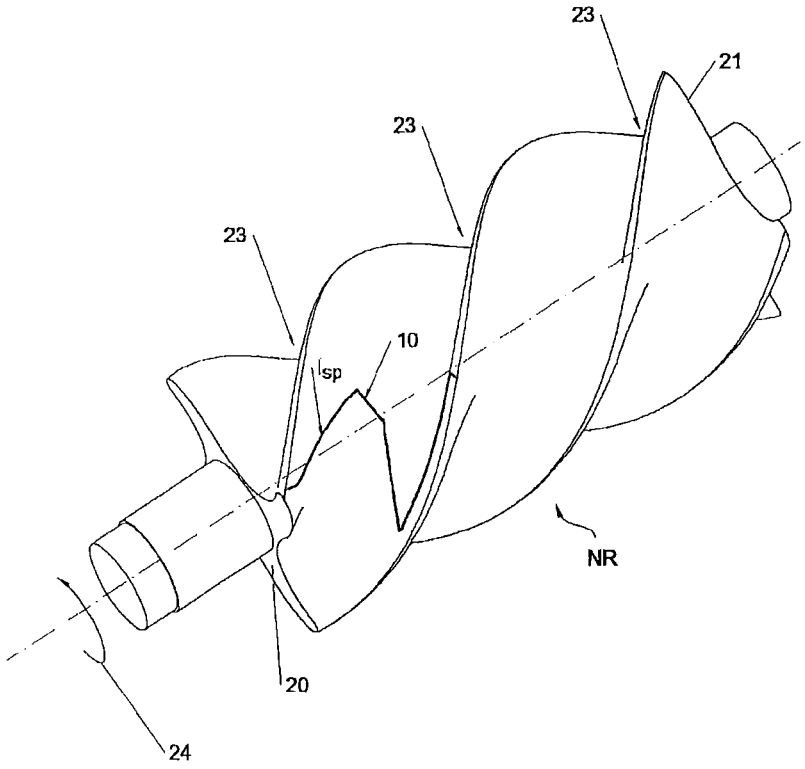
FIG. 11 shows a perspective view of one embodiment of a secondary rotor to illustrate the spatial line of engagement.

FIG. 11 shows the spatial line of engagement 10 of precisely one tooth gap 23. The profile gap length $I_{sp}$ is the length of the spatial line of engagement of precisely one tooth gap 23. This therefore corresponds to the profile gap length of precisely one tooth pitch.

Figure 12A:
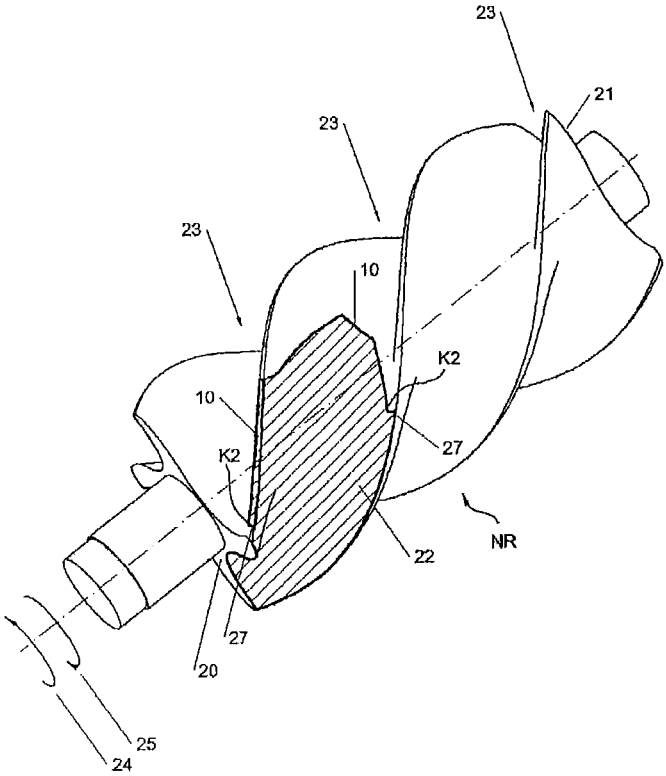
FIG. 12*a*, 12*b* shows an illustration of the areas or subareas of a working chamber of one embodiment of the secondary rotor which are relevant for the torque effects.

The entire torque of the gas forces on the secondary rotor is composed of the sum of the torque effects of the gas pressures in all working chambers on the sub-surfaces of the secondary rotor delimiting the respective working chambers. In FIG. 12*a* such a sub-surface (22) of the secondary rotor delimiting a working chamber is shown hatched as an example.

Figure 12B:
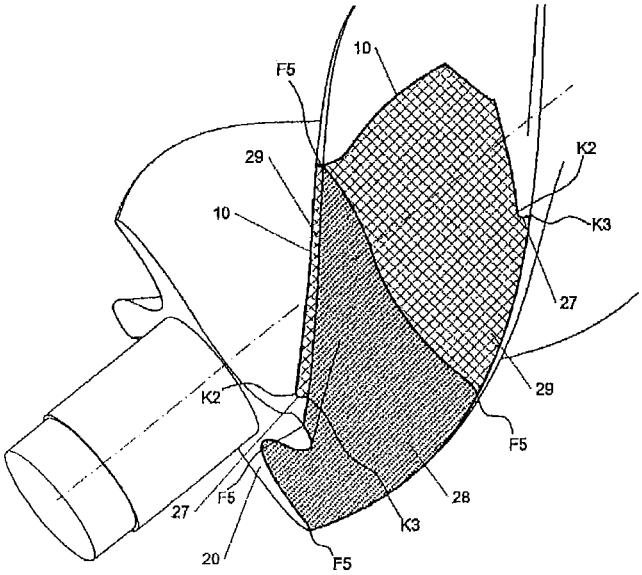
Figure 13:
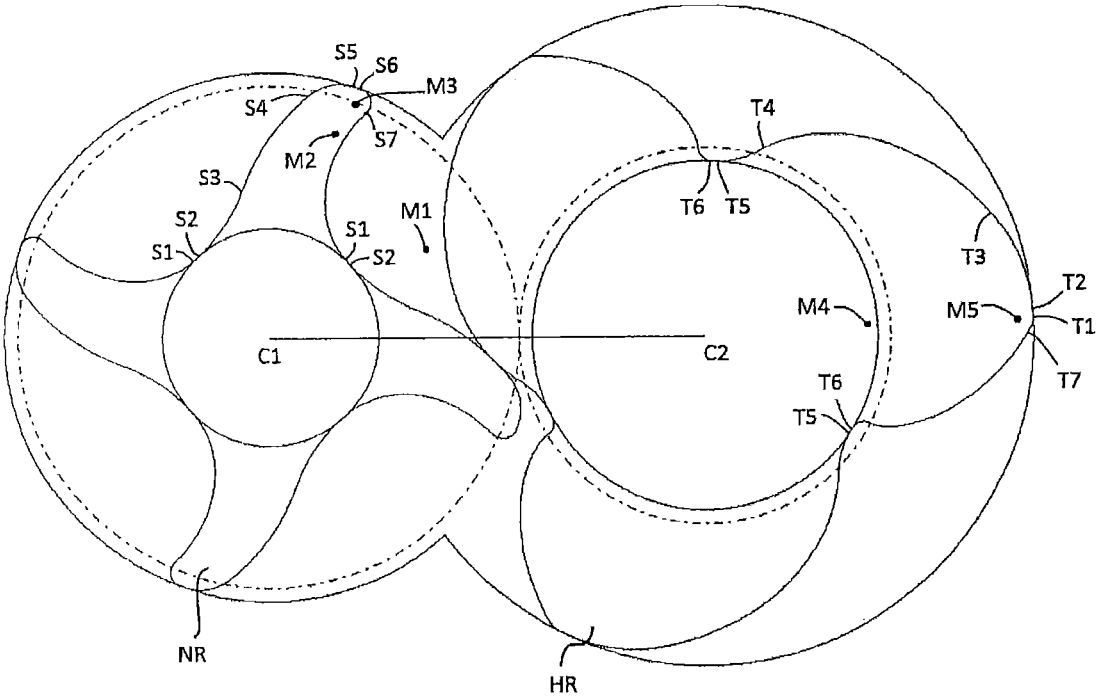
FIG. 13 shows the transverse section of the embodiment according to FIG. 1 to explain the profile course of main and secondary rotor in this embodiment.
Figure 14:
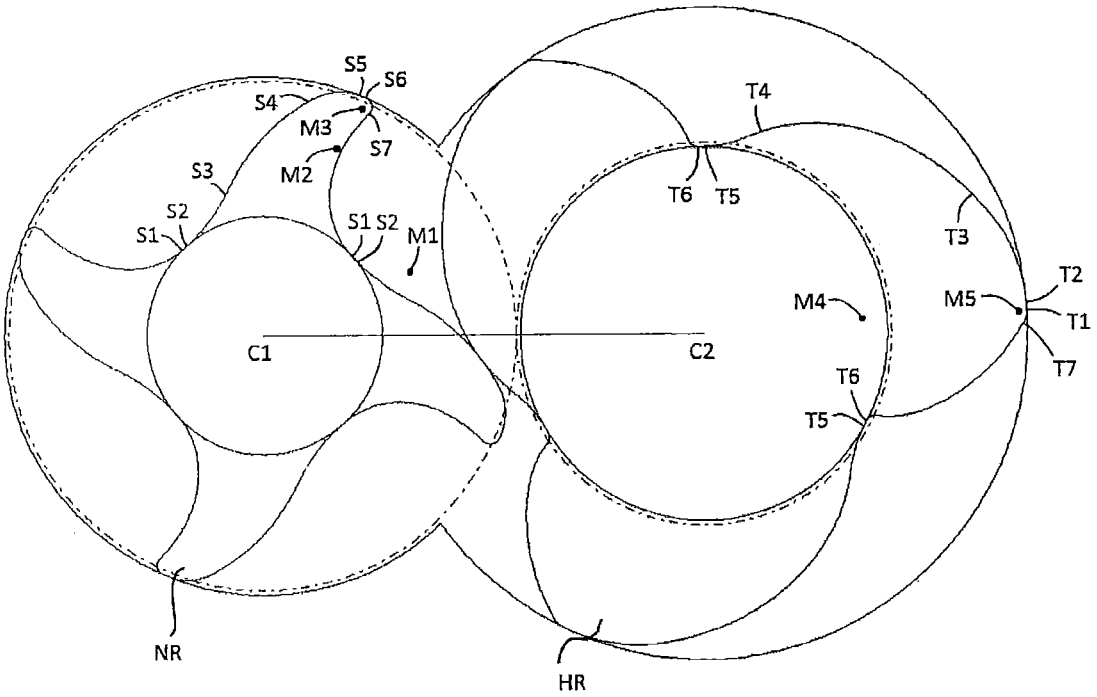
FIG. 14 shows the transverse section of the embodiment according to FIG. 2 to explain the profile course of main and secondary rotor in this embodiment.
Figure 15:
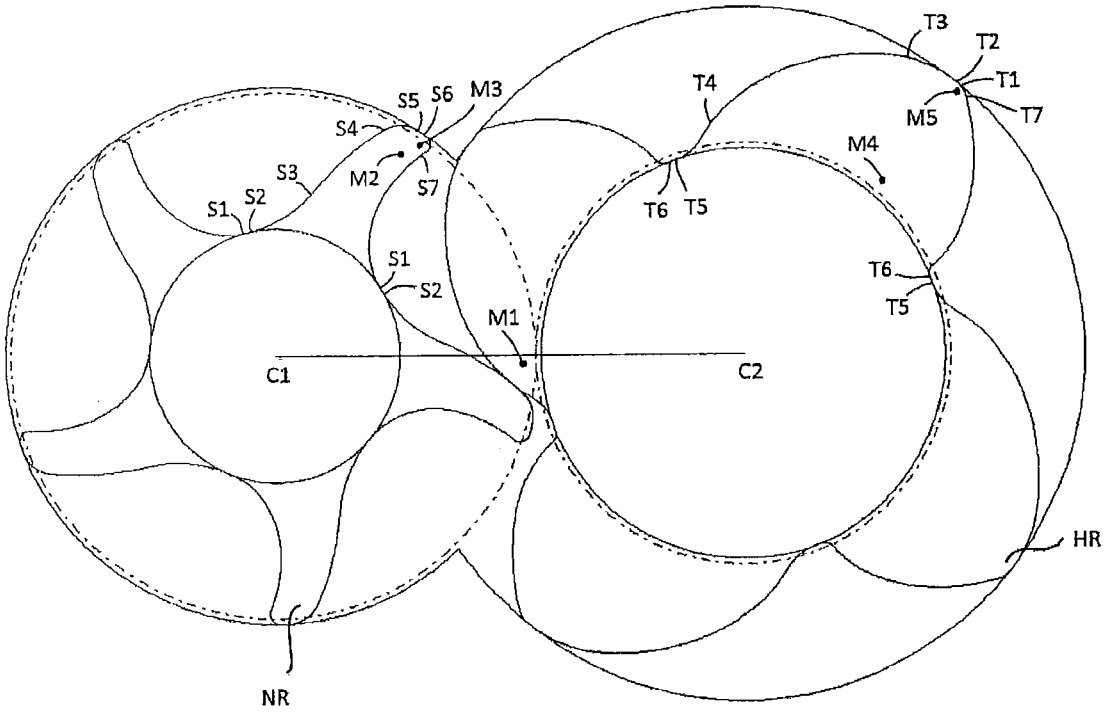
FIG. 15 shows the transverse section of the embodiment according to FIG. 3 to explain the profile course of main and secondary rotor in this embodiment.
Figure 16:
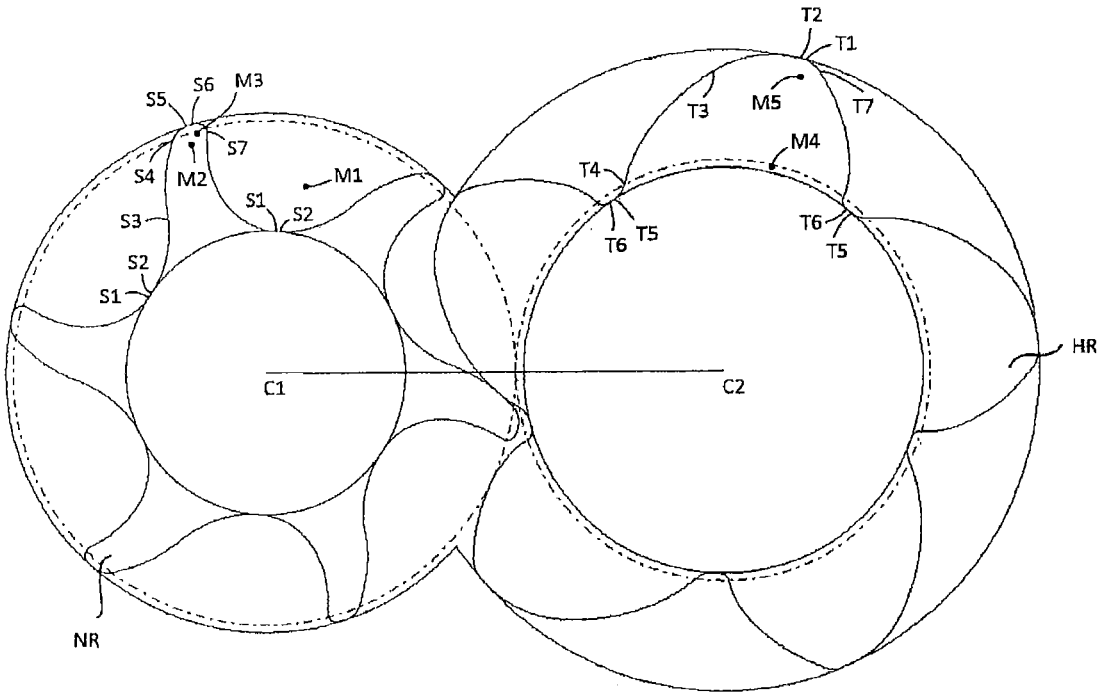
FIG. 16 shows the transverse section of the embodiment according to FIG. 4 to explain the profile course of main and secondary rotor in this embodiment.

FIG. 12*b* shows the division of the sub-surface (22) delimiting a working chamber, shown in FIG. 12*a* into an area (28) shown dotted and an area (29) shown cross-hatched. Only the cross-hatched area (29) makes a contribution to the torque.

The sub-surface (22) is obtained from the specific transverse sectional configuration and pitch of the secondary rotor. The pitch of the secondary rotor relates to the pitch of the screw-shaped toothed structure of the secondary rotor. The three-dimensional line of engagement (10) delimiting the sub-surface, also shown in FIG. 12*a* is also specified by the transverse sectional configuration of the secondary rotor and the pitch.

Sub-surface (22) is also delimited by line of intersection (27). Details on the line of intersection (27) have already been presented and described within the framework of FIGS. 7*b* and 7*k*. The same applies to the engagement line point K2.

The specific length of a working chamber in the direction of the axis of rotation, which is dependent on the angular position of the secondary rotor with respect to the main rotor, between the secondary rotor end face (20) on the one hand and the delimitation by the three-dimensional line of engagement (10) and line of intersection (27) on the other hand does not play any significant role here because—as is described in the relevant literature—the gas pressures on regions of the rotor surface which in a sectional plane perpendicular to the axis of the rotor correspond to complete tooth gaps (shown dotted in FIG. 12*b*) make no contribution to the torque. The pitch of the secondary rotor only has an effect on the magnitude but not on the direction of action of the torque.

The area (28) shown dotted in FIG. 12*b* and the area (29) shown cross-hatched in FIG. 12*b* together form the sub-surface (22).

Only the area (29) shown cross-hatched in FIG. 12*b* makes a contribution to the torque.

Thus, in each working chamber, the direction of action of the torque which is brought about by the gas pressure in the working chamber (or an arbitrary reference pressure) on the sub-surface of the secondary rotor delimiting the working chamber, is specified by the transverse sectional configuration of the secondary rotor.

The above-described advantageous transverse sectional configuration of the secondary rotor (NR) thus results for each sub-surface (22) of the secondary rotor delimiting a working chamber and thus for the entire secondary rotor in a direction of action (25) of the torque from the gas forces which is directed contrary to the direction of rotation (24) of the secondary rotor, whereby rotor rattling is effectively avoided.

The exemplary embodiments presented confirm that with the present invention a considerable increase in efficiency could be achieved for a rotor pair used in screw machines consisting of main rotor and secondary rotor having a corresponding profile geometry.

With the present invention it has been possible to further improve the efficiency and smooth running of rotor profiles compared with the prior art independently of a specifically claimed profile definition.

Although it will easily be possible for the person skilled in the art using the specified parameter values to produce suitable profile courses using conventional methods in the prior art, purely as an example the profile courses in the previously discussed exemplary embodiments according to FIGS. 1 to 4 will be explained in detail hereinafter. As is best known to the person skilled in the art working in the present field, in order to generate profile courses, profile courses can also be generated using publicly accessible computer programs.

Purely as an example in this connection mention is made of SV_Win, a project of Vienna Technical University, where this software is described in great detail in the Grafinger post-doctoral thesis. An alternative, publicly accessible computer program is moreover the DISCO software and in particular the SCORPATH module of the City University London (Centre for Positive Displacement Compressor Technology). General information on this can be obtained from: http://www.city.compressors.co.uk/. Information on installation of the software can be obtained from http://www.staff.city.ac.uk/~ra600?DISCO/DISCO/Installation%20instructions.pdf. A software can be found at preview of the DISCO http://www.staff.city.ac.uk/~ra600/DISCO/DISCO%20-Preview.htm.

Another alternative software is the software Screw View which is also mentioned in the thesis "Directed Evolutionary Algorithms" by Stefan Berlik, Dortmund 2006 (p. 173 f.). On the internet page http://pi.informatik.uni-siegen.de/Mitarbeiter/berlik/projekte/ the ScrewView software is described in detail in connection with the project "Method for the design of dry-running rotary compressor machines."

In FIGS. 13 to 16 a tooth with trailing rotor flank $F_N$ and leading rotor flank $F_V$ is specifically produced as follows: the section S1 to S2 is obtained from a circular arc on the secondary rotor NR about the centre point C1 produced by the circular arc section T1 to T2 about the centre point C2 on the main rotor HR. The section S2 to S3 is obtained from an envelope curve to a trochoid produced by circular arc section T2 to T3 about the centre point M4 on the main rotor HR. The section S3 to S4 is defined by a circular arc about the centre point M1. The section S4 to S5 is predefined by a circular arc about the centre point M2.

The section S5 to S6 is specified by a circular arc about the centre point C1. The adjoining section S6 to S7 is predefined by a circular arc about the centre point M3. The section S7 to S1 is finally predefined by an envelope curve to a trochoid produced by the circular arc section T7 to T1 about the centre point M5 on the main rotor HR. The previously described sections each adjoin one another seamlessly in the specified sequence. The tangents at the end of one section and at the beginning of the adjacent section are each the same. The sections in this respect merge into one another directly, smoothly and free from bends.

The profile course of the teeth of the main rotor HR is explained briefly hereinafter for the exemplary embodiment according to FIGS. 1 to 4 also with reference to FIGS. 13 to 16. The section T1-T2 is obtained by a circular arc on the main rotor HR about the centre point C2 on the main rotor HR. The section T2-T3 is defined by the circular arc on the main rotor HR about the centre point M4. The section T3-T4 is obtained from an envelope curve to a trochoid produced by the section S3-S4 on the secondary rotor NR. The section T4-T5 is predefined by an envelope curve to a trochoid produced by the section S4-S5 on the secondary rotor. The section T5-T6 is defined by a circular arc about the centre point C2 produced by the circular arc section S5-S6 about the centre point C1 on the secondary rotor NR. The section T6-T7 is obtained by an envelope curve to a trochoid produced by the section S6-S7 on the secondary rotor NR. The section T7-T1 finally is specified by a circular arc about the centre point M5. Here it also applies that: the previously described sections each adjoin one another seamlessly in the specified sequence. The tangents at the end of one section and at the beginning of the adjacent section are each the same. The sections in this respect merge into one another directly, smoothly and free from bends.

In general it should be noted that the profile courses of secondary rotor NR and main rotor HR are naturally matched to one another and in this respect the envelope curves to a trochoid each correspond to circular arc sections on the counter-rotor. Furthermore, as already mentioned a tangential transition from one to the next section is ensured. A general procedure for calculating the profile course of the counter rotor is described for example in the Helpertz thesis "Method for stochastic optimization of screw rotor profiles", Dortmund 2003, p. 60 ff.

What is claimed is:

1. A rotor pair for a compressor block of a screw compressor, wherein the rotor pair comprises:

a secondary rotor that rotates about a first axis and a main rotor that rotates about a second axis, wherein a number of teeth of the main rotor is 5 and a number of teeth of the secondary rotor is 6, wherein a relative profile depth of the secondary rotor $$PT_{rel} = \frac{rk_1 - rf_1}{rk_1}$$

is between 0.44 and 0.495, wherein $rk_1$ is an addendum circle radius drawn around the outer circumference of the secondary rotor and $rf_1$ is a dedendum circle radius starting at the profile base of the secondary rotor, and wherein for a rotor length ratio $L_{HR}/a$:

$$1.4 \le L_{HR}/a \le 3.2,$$

wherein the rotor length ratio is formed from a ratio of the rotor length $L_{HR}$ of the main rotor and an axis distance a, and the rotor length $L_{HR}$ of the main rotor is formed by a distance of a suction-side main-rotor rotor end face to an opposite pressure-side main-rotor rotor end face, wherein in a transverse sectional view within a secondary rotor tooth a tooth thickness delimited by a leading tooth flank $F_V$ and a trailing tooth flank $F_N$ yields a tooth thickness ratio between a thickness at a point along the tooth that is a dedendum circle radius plus 50% of a difference between the addendum circle radius and the dedendum circle radius and a thickness at a point along the tooth that is the dedendum circle radius plus 25% of the difference between the addendum circle radius and the dedendum circle radius, $\varepsilon_1$, that is $0.76 \le \varepsilon_1 < 0.86$ and tooth thickness ratio between a thickness at a point along the tooth that is a dedendum circle radius plus 75% of a difference between the addendum circle radius and the dedendum circle radius and a thickness at a point along the tooth that is the dedendum circle radius plus 25% of the difference between the addendum circle radius and the dedendum circle radius, $\varepsilon_2$, that is $0.62 \le \varepsilon_2 \le 0.72$.

2. The rotor pair according to claim 1, wherein the main rotor is formed with a wrap-around angle $\phi_{HR}$ for which $320° \le \phi_{HR} \le 360°$.

3. The rotor pair according to claim 1, wherein a blow hole factor $\mu_{B1}$ is between 0.03% and 0.25%, wherein $$\mu_{Bl} = \frac{A_{Bl}}{A6 + A7} * 100[\%]$$

and wherein $A_{B1}$ designates an absolute pressure-side blow hole area and A6 and A7 designate tooth gap areas of the secondary rotor or the main rotor, wherein an area A6 in a transverse sectional view is an area enclosed between a profile course of the secondary rotor between two adjacent apex points F5 and an addendum circle $KK_1$ and an area A7 in a transverse sectional view is an area enclosed between the profile course of the main rotor between two adjacent apex points H5 and an addendum circle $KK_2$.

4. The rotor pair according to claim 1, wherein for a blow hole/profile gap length factor $\mu_1 * \mu_{B1}$ $$0.1\% \le \mu_1 * \mu_{B1} \le 1.26\%$$

where $$\mu_l = \frac{l_{sp}}{PT_1},$$

where $l_{sp}$ designates a length of a profile engagement gap of a tooth gap of the secondary rotor and $PT_1$ designates a profile depth of the secondary rotor where $PT_1=rk_1-rf_1$ and $$\mu_{Bl} = \frac{A_{Bl}}{A6 + A7} * 100[\%]$$

where $A_{B1}$ designates an absolute blow hole area and A6 and A7 designate a profile areas of the secondary rotor or the main rotor, wherein the profile area A6 in a transverse sectional view designates an area enclosed between a profile course of the secondary rotor between two adjacent apex points F5 and the addendum circle $KK_1$, and the profile area A7 in a transverse sectional view designates an area enclosed between the profile course of the main rotor between two adjacent apex points H5 and the addendum circle $KK_2$.

5. The rotor pair according to claim 1, wherein the main rotor and secondary rotor are configured and tuned to one another such that a dry compression with a pressure ratio Π of up to 5 is achieved, where the pressure ratio is a ratio of compression end pressure to suction pressure.

6. The rotor pair according to claim 1, wherein the main rotor is configured to be operated relative to an addendum circle $KK_2$ at a circumferential speed in a range from 20 to 100 m/s.

7. The rotor pair according to claim 1, wherein for a diameter ratio defined by a ratio of an addendum circle radii of the main rotor and the secondary rotor $$D_v = \frac{Dk_2}{Dk_1} = \frac{rk_2}{rk_1}$$

$$1.19 \le D_v \le 1.26$$

where $Dk_1$ designates a diameter of an addendum circle $KK_1$ of the secondary rotor, $Dk_2$ designates a diameter of an addendum circle $KK_2$ of the main rotor, and $rk_2$ designates an addendum circle radius of the main rotor.

8. A rotor pair for a compressor block of a screw compressor, wherein the rotor pair comprises a secondary rotor that rotates about a first axis and a main rotor that rotates about a second axis, wherein a number of teeth of the main rotor is 5 and a number of teeth of the secondary rotor is 6, wherein a relative profile depth of the secondary rotor $$PT_{rel} = \frac{rk_1 - rf_1}{rk_1}$$

is between 0.44 and 0.495, wherein $rk_1$ is an addendum circle radius drawn around an outer circumference of the secondary rotor and $rf_1$ is a dedendum circle radius starting at a profile base of the secondary rotor, and wherein for a rotor length ratio $L_{HR}/a$:

$$1.4 \le L_{HR}/a \le 3.2,$$

wherein the rotor length ratio is formed from a ratio of the rotor length $L_{HR}$ of the main rotor and an axis distance a and the rotor length $L_{HR}$ of the main rotor is formed by a distance of a suction-side main-rotor rotor end face to an opposite pressure-side main-rotor rotor end face and, in a transverse sectional view, arc lengths b(r), running inside a tooth of the secondary rotor, of respectively appurtenant concentric circular arcs having a radius $rf_1<r<rk_1$ and a common central point defined by the first axis of the secondary rotor, are each delimited by a leading tooth flank $F_V$ and a trailing tooth flank $F_N$ and the arc lengths b(r) decrease monotonically with increases in the radius r.

9. The rotor pair according to claim 8, wherein in a transverse sectional view, circular arcs $B_{25}$, $B_{50}$, $B_{75}$ running within a secondary rotor tooth are defined, a common centre point of which is given by the first axis of the secondary rotor, wherein a radius $r_{25}$ of $B_{25}$ has a value $r_{25}=rf_1+0.25*(rk_1-rf_1)$, a radius $r_{50}$ of $B_{50}$ has a value $r_{50}=rf_1+0.5*(rk_1-rf_1)$, and a radius $r_{75}$ of $B_{75}$ has a value $r_{75}=rf_1+0.75*(rk_1-rf_1)$, and wherein the circular arcs $B_{25}$, $B_{50}$, $B_{75}$ are each delimited by a leading tooth flank $F_V$ and a trailing tooth flank $F_N$, wherein tooth thickness ratios are defined as ratios of arc lengths $b_{25}$, $b_{50}$, $b_{75}$ of the circular arcs $B_{25}$, $B_{50}$, $B_{75}$ with $\varepsilon_1=b_{50}/b_{25}$ and $\varepsilon_2=b_{75}/b_{25}$ and at least one of $0.76\le\varepsilon_1<0.086$ and $0.62\le\varepsilon_2\le0.72$.

10. The rotor pair according to claim 8, wherein in a transverse sectional view, foot points F1 and F2 are defined between an observed tooth of the secondary rotor and a respectively adjacent tooth of the secondary rotor and an apex point F5 is defined at a radially outermost point of the observed tooth, wherein a triangle $D_z$ is defined by the foot points F1, F2 and the apex point F5 and wherein in a radially outer region, the observed tooth projects beyond the triangle $D_z$ with its leading tooth flank $F_V$ formed between the apex point F5 and the foot point F2 with an area A1 and with its trailing tooth flank $F_N$ formed between the foot point F1 and the apex point F5 with an area A2 and wherein $4\le A2/A1\le7$.

11. The rotor pair according to claim 8, wherein in a transverse sectional view, foot points F1 and F2 are defined between an observed tooth of the secondary rotor and a respectively adjacent tooth of the secondary rotor and an apex point F5 is defined at a radially outermost point of the observed tooth, wherein a triangle $D_z$ is defined by the foot points F1, F2 and the apex point F5 and wherein in a radially outer region of the observed tooth, a leading tooth flank $F_V$ formed between the apex point F5 and tooth point F2 projects with an area A1 beyond the triangle $D_z$ and in a radially inner region is set back with respect to the triangle $D_z$ with an area A3 and wherein $8\le A3/A1\le14$.

12. The rotor pair according to claim 8, wherein in a transverse sectional view, foot points F1 and F2 are defined between an observed tooth of the secondary rotor and a respectively adjacent tooth of the secondary rotor and an apex point F5 is defined at a radially outermost point of the observed tooth, wherein a triangle $D_z$ is defined by the foot points F1, F2 and the apex point F5 and wherein in a radially outer region of the observed tooth, a leading tooth flank $F_V$ formed between the apex point F5 and the foot point F2 projects with an area A1 beyond the triangle $D_Z$, wherein the observed tooth itself has a cross-sectional area A0 delimited by a circular arc B running between the foot points F1 and F2 about a centre point defined by the first axis and wherein $1.9\%\le A1/A0\le3.2\%$.

13. The rotor pair according to claim 8, wherein in a transverse sectional view, foot points F1 and F2 are defined between an observed tooth of the secondary rotor and the respectively adjacent tooth of the secondary rotor and an apex point F5 is defined at a radially outermost point of the observed tooth, wherein a circular arc B running between the foot points F1 and F2 defines a tooth partition angle γ corresponding to 360°/number of teeth of the secondary rotor about a centre point defined by the first axis, wherein a point F11 is defined on the circular arc B between the foot points F1 and F2, wherein a radial half-line R drawn from the centre point of the secondary rotor defined by the first axis through the apex point F5 intersects the circular arc B at a point F12, wherein an offset angle β is defined by an offset of the points F11 to F12 viewed in a direction of rotation of the secondary rotor and wherein $$13.5\% \leq \delta \leq 18\%$$

where $$\delta = \frac{\beta}{\gamma} * 100[\%].$$

14. A rotor pair for a compressor block of a screw machine, comprising a secondary rotor that rotates about a first axis and a main rotor that rotates about a second axis, wherein a number of teeth of the main rotor is 5 and a number of teeth of the secondary rotor is 6, wherein a relative profile depth of the secondary rotor $$PT_{rel} = \frac{rk_1 - rf_1}{rk_1}$$

is between 0.44 and 0.495 wherein $rk_1$ is an addendum circle radius drawn around an outer circumference of the secondary rotor and $rf_1$ is a dedendum circle radius starting at a profile base of the secondary rotor, wherein a ratio of the axis distance a of the first axis from the second axis and the addendum circle radius $rk_1$ $$\frac{a}{rk_1}$$

is between 1.74 and 1.8, wherein the main rotor is configured with a wrap-around angle $\phi_{HR}$ for which $240° \leq \phi_{HR} \leq 360°$, and wherein for a rotor length ratio $L_{HR}/a$ $$1.4 \leq L_{HR}/a \leq 3.2,$$

wherein the rotor length ratio is formed from a ratio of a rotor length $L_{HR}$ of the main rotor and the axis distance a and a rotor length $L_{HR}$ of the main rotor is formed by a distance of a suction-side main-rotor rotor end face to an opposite pressure-side main-rotor rotor end face, wherein a transverse sectional configuration of the secondary rotor is executed such that a direction of action of torque which results from a reference pressure on a partial surface of the secondary rotor delimiting a working chamber is directed contrary to a direction of rotation of the secondary rotor.

15. The rotor pair according to claim 14, wherein in a transverse sectional view, circular arcs $B_{25}$, $B_{50}$, $B_{75}$ running within a secondary rotor tooth are defined, a common centre point of which is given by the first axis, wherein a radius $r_{25}$ of $B_{25}$ has a value $r_{25}=rf_1+0.25*(rk_1-rf_1)$, a radius $r_{50}$ of $B_{50}$ has a value $r_{50}=rf_1+0.5*(rk_1-rf_1)$, and a radius $r_{75}$ of $B_{75}$ has a value $r_{75}=rf_1+0.75*(rk_1-rf_1)$, and wherein the circular arcs $B_{25}$, $B_{50}$, $B_{75}$ are each delimited by a leading tooth flank $F_V$ and a trailing tooth flank $F_N$, wherein tooth thickness ratios are defined as ratios of the arc lengths $b_{25}$, $b_{50}$, $b_{75}$ of the circular arcs $B_{25}$, $B_{50}$, $B_{75}$ with $\varepsilon_1=b_{50}/b_{25}$ and $\varepsilon_2=b_{75}/b_{25}$ and at least one of $0.76 \leq \varepsilon_1 \leq 0.86$ and $0.62 \leq \varepsilon_2 \leq 0.72$.

16. The rotor pair according to claim 14, wherein in dry compression the main rotor is configured to be operated relative to an addendum circle $KK_2$ at a circumferential speed of from 20 to 100 m/s and in fluid-injected compression the main rotor is configured to be operated relative to the addendum circle $KK_2$ at the circumferential speed of from 5 to 50 m/s.

17. The rotor pair according to claim 14, wherein in a transverse sectional view, a profile of a tooth of the secondary rotor relative to a radial half-line R drawn from a centre point defined by the first axis of the secondary rotor through an apex point F5 is configured to be asymmetrical.

18. The rotor pair according to claim 14, wherein in a transverse sectional view a point C is defined on a connecting section between the first axis and the second axis where pitch circles $WK_1$ of the secondary rotor and $WK_2$ of the main rotor contact, a point of intersection K5 of a dedendum circle $FK_1$ of the secondary rotor with the connecting section where radius $r_1$ determines a distance between the point of intersection K5 and the point C and a point K4 of a suction-side part of a line of engagement which lies at a greatest distance from the connecting section between the first axis and the second axis, where radius $r_2$ determines a distance between the point K4 and the point C and where:

$$0.9 \leq \frac{r_1}{r_2} \leq 0.875 \times \frac{z_1}{z_2} + 0.22$$

where $z_1$ is a number of teeth of the secondary rotor and $z_2$ is a number of teeth of the main rotor.

* * * * *